US008038486B1

(12) United States Patent
Nakamura

(10) Patent No.: US 8,038,486 B1
(45) Date of Patent: Oct. 18, 2011

(54) CONNECTOR

(75) Inventor: Hideto Nakamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/967,103

(22) Filed: Dec. 14, 2010

(30) Foreign Application Priority Data

May 20, 2010 (JP) ..... 2010-116074
May 20, 2010 (JP) ..... 2010-116076
May 20, 2010 (JP) ..... 2010-116077

(51) Int. Cl.
*H01R 13/436* (2006.01)

(52) U.S. Cl. ..... 439/752

(58) Field of Classification Search ..... 439/752, 439/595

See application file for complete search history.

(56) References Cited

U.S. PATENT DOCUMENTS 5,820,421 A * 10/1998 Makino ..... 439/752
5,980,331 A * 11/1999 Matsushita et al. ..... 439/752
6,551,145 B2 * 4/2003 Kurimoto et al. ..... 439/752
7,175,483 B2 * 2/2007 Ishikawa ..... 439/752
7,204,726 B2 * 4/2007 Yamashita et al. ..... 439/752
7,553,186 B2 6/2009 Morikawa et al.
7,717,758 B2 * 5/2010 Fukamachi ..... 439/752

FOREIGN PATENT DOCUMENTS

JP 2000-306632 11/2000
JP 2003-007392 1/2003

* cited by examiner

*Primary Examiner* — Gary F. Paumen
(74) *Attorney, Agent, or Firm* — Gerald E. Hespos; Michael J. Porco

(57) ABSTRACT

A locking projection (29) of a housing (10) fits in a temporary locking concavity (65) of a retainer (60) to hold the retainer (60) at a temporary locking position and fits in a main locking concavity (64) to hold the retainer (60) at a main locking position. The main locking concavity (64) has a first slope (67) on a forward surface in a direction in which the retainer (60) is drawn out. The temporary locking concavity (65) has a first locking surface (69) on a forward surface and aligned orthogonal to the direction in which retainer (60) is drawn out. The locking projection (29) has a second slope (35) aligned along a surface of the first slope (67) at the main locking position and has a second locking surface (33) disposed along a surface direction of the first locking surface (69) at the temporary locking position.

10 Claims, 24 Drawing Sheets

CONNECTOR

BACKGROUND OF THE INVENTION

1. Field of the Invention

The invention relates to a connector.

2. Description of the Related Art

A conventional connector has a housing into which terminal fittings can be inserted and a retainer mounted in a mounting hole of the housing for movement between a temporary locking position and a main locking position. A temporary locking concavity and a main locking concavity are formed side by side on an inner surface of the mounting hole. A flexible elastic piece is formed on the retainer and a locking projection is formed on the elastic piece. The locking projection can fit elastically in the temporary locking concavity to hold the retainer at the temporary locking position. The locking projection also can fit elastically in the main locking concavity to hold the retainer at the main locking position.

The main locking concavity has a first slope, the locking projection has a second slope and the temporary locking concavity has a third slope. The first slope is formed at a forward portion of the main locking concavity in the direction in which the retainer is drawn out and is inclined along the direction in which the retainer is drawn out. The third slope formed at a forward portion of the temporary concavity in the direction in which the retainer is drawn out and is inclined along the direction in which the retainer is drawn out. The second slope is disposed substantially along the surface direction of the third slope when the retainer is at the temporary locking position and is disposed substantially along the surface direction of the first slope when the retainer is at the main locking position. The retainer can be returned smoothly to the temporary locking position because the second slope slides on the first slope.

The retainer of the above-described connector can be moved from the main locking position to the temporary locking position. However, there are times when the second slope of the locking projection slides on the third slope of the temporary locking concavity so that the retainer separates from the housing without the being stopped at the temporary locking position.

The connector can be provided with a dedicated locking construction separate from the locking projection for securely stopping the retainer at the temporary locking position. However, the construction of the connector then becomes undesirably complicated.

The invention was completed based on the above-described situation. It is an object of the invention to prevent a retainer from being separated from a housing without a complicated construction.

SUMMARY OF THE INVENTION

The invention relates to a connector with a housing that can be fit on a mating housing and into which terminal fittings can be inserted. A retainer is mounted on the housing movably between a temporary locking position and a main locking position. The retainer allows the terminal fittings to be inserted into the housing at the temporary locking position, but prevents the terminal fittings from being drawn out of the housing at the main locking position. A temporary locking concavity and a main locking concavity are formed on one of the housing and the retainer. A locking projection is formed on the other of the housing and the retainer. The locking projection can fit elastically in the temporary locking concavity to hold the retainer at the temporary locking position. The locking projection also can fit elastically in the main locking concavity to hold the retainer at the main locking position. The main locking concavity has a first slope on a forward surface thereof in a direction in which the retainer is drawn out. The first slope is inclined along the direction in which the retainer is drawn out. The temporary locking concave portion has a first locking surface on a forward surface thereof in the direction in which the retainer is drawn out. The first locking surface is substantially orthogonal to the direction in which the retainer is drawn out. The locking projection has a second slope on a forward surface thereof in the direction in which the retainer is drawn out. The second slope is disposed on the first slope substantially along a surface direction of the first slope at the main locking position. A second locking surface is formed on the forward surface of the locking projection in the direction in which the retainer is drawn out. The second locking surface is disposed substantially along a surface direction of the first locking surface at the temporary locking position.

The second slope of the locking projection preferably is disposed at both sides of the second locking surface.

An escape hole preferably is formed on one of the housing and the retainer at a position between the main locking concavity and the temporary locking concavity. The escape hole extends in a direction in which the retainer moves and receives the second locking surface of the locking projection during a movement of the retainer.

The first slope is formed on the forward surface of the main locking concavity in the direction in which the retainer is drawn out and the first slope inclines along the direction in which the retainer is drawn out. The second slope is formed on the forward surface of the locking projection in the direction in which retainer is drawn out by disposing the second slope substantially along the surface direction of the first slope at the main locking position. Therefore, the first and second slopes slide smoothly on each other when returning the retainer to the temporary locking position from the main locking position.

The temporary locking concavity has the first locking surface formed on the forward surface thereof in the direction in which the retainer is drawn out. The first locking surface is substantially orthogonal to the direction in which retainer is drawn out. The locking projection has the second locking surface disposed substantially along the surface direction of the first locking surface at the temporary locking position. Therefore, the first and second locking surfaces are locked together tightly as the retainer advances to the temporary locking position and the retainer cannot separate from the housing. In this case, the second slope and the second locking surface are formed together on the locking projection. Thus the housing has a simple construction as compared with a construction in which the second slope and the second locking surface are formed at different portions.

The second slope is disposed at both sides of the second locking surface. Thus, the retainer has a favorable balance in its movement posture when the first slope and second slopes slide on each other.

The second locking surface of the locking projection penetrates the escape hole during movement of the retainer. More particularly, the second locking surface is formed on the housing or the retainer by extending the escape hole in the movement direction of the retainer between the main locking concavity and the temporary locking concavity. Therefore the second locking surface does not interfere with the first slope and the retainer moves smoothly. In addition, this construction can secure a large locking area of the second locking surface to prevent removal of the retainer.

DETAILED DESCRIPTION OF THE PREFERRED EMBODIMENTS

Figure 1:
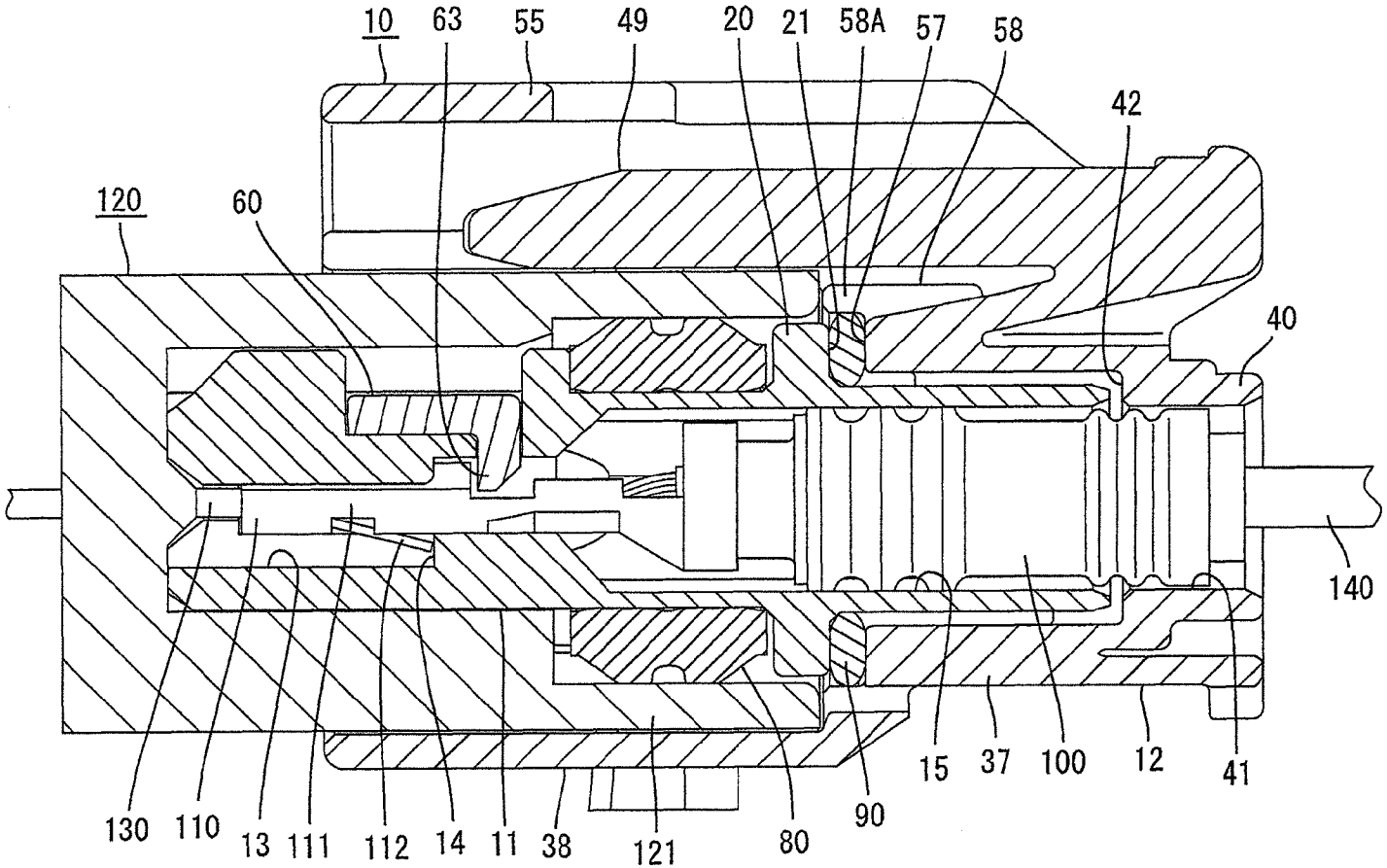
FIG. 1 is a sectional view showing a state in which a connector of an embodiment 1 of the present invention is normally fitted on a mating connector.

A connector in accordance with the invention has a housing 10 that can be fit on a mating housing 120, as shown in FIG. 1. In the following description, fit-on ends of the housings 10 and 120 are referred to as the front end and reference to the vertical direction is based on the orientation of FIG. 1.

The mating housing 120 is made of synthetic resin and has a forwardly projecting tubular hood 121, as shown in FIG. 1. Tab-shaped mating terminal fittings 130 are arranged widthwise in the hood 121. An unshown lock projects on an upper surface of an upper wall of the hood 121.

The housing 10 has an inner housing 11 made of synthetic resin and an outer housing 12 made of synthetic resin that fits on the inner housing 11.

The inner housing 11 is block-shaped and cavities 13 penetrate the inner housing 11 longitudinally. The cavities 13 are arranged widthwise in the inner housing 11. A lance-receiving step 14 is formed on an inner surface of each cavity 13. A sectionally circular sealing hole 15 having a longitudinally uniform diameter is formed at a rear of each cavity 13.

Terminal fittings 110 are inserted into the cavities 13 from the rear. A tubular body 111 is formed at a front portion of each terminal fitting 110. A flexible elastic locking piece 112 is formed on the body 111 by partly cutting and bending the cut part diagonally down and back. The elastic locking piece 112 elastically deflects and then locks to the lance-receiving portion 14 when terminal fittings 110 are inserted normally into the respective cavities 13 to prevent the terminal fittings 110 from being removed from the cavities 13. The mating terminal fittings 130 are inserted respectively into the bodies 111 of the terminal fittings 110 and connect when the housings 10 and 120 are fit together.

A rear end of the terminal fitting 110 is caulked into connection with an end of an electric wire 140 and a long tubular rubber stopper 100 is fit on the electric wire 140. The rubber stopper 100 closely contacts the peripheral surface of the electric wire 140 and the inner peripheral surface of the sealing hole 15 when the terminal fittings 110 are inserted normally into the respective cavities 13.

Figure 8:
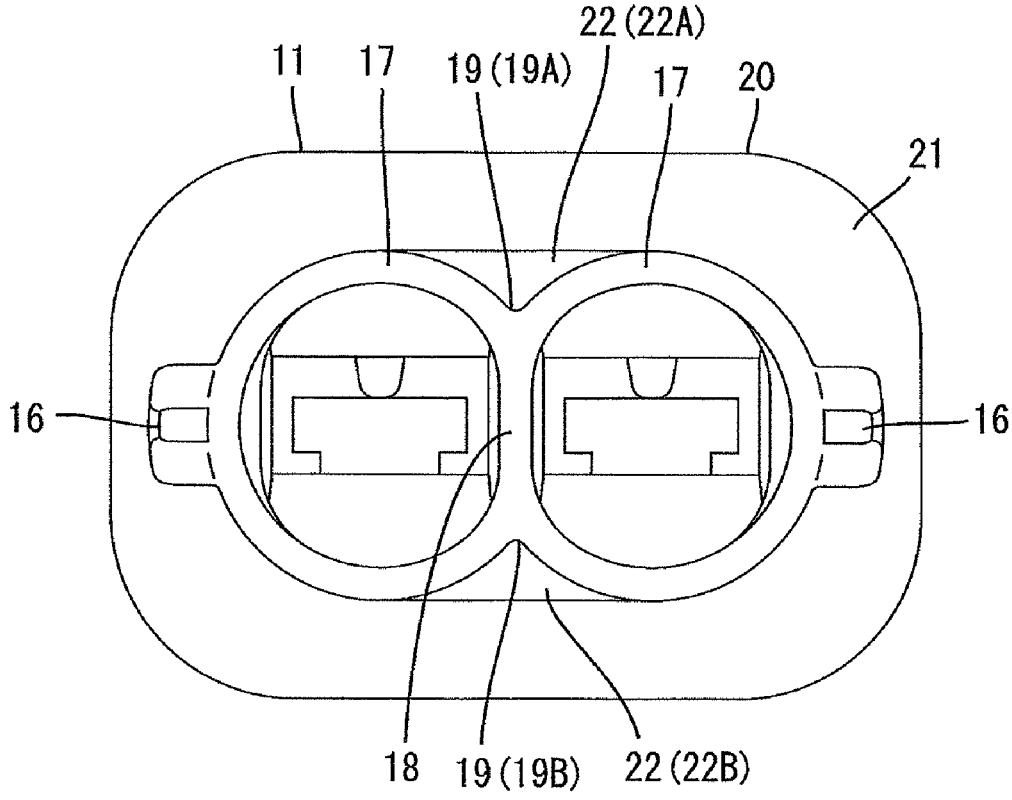
FIG. 8 is a rear view of an inner housing.
Figure 9:
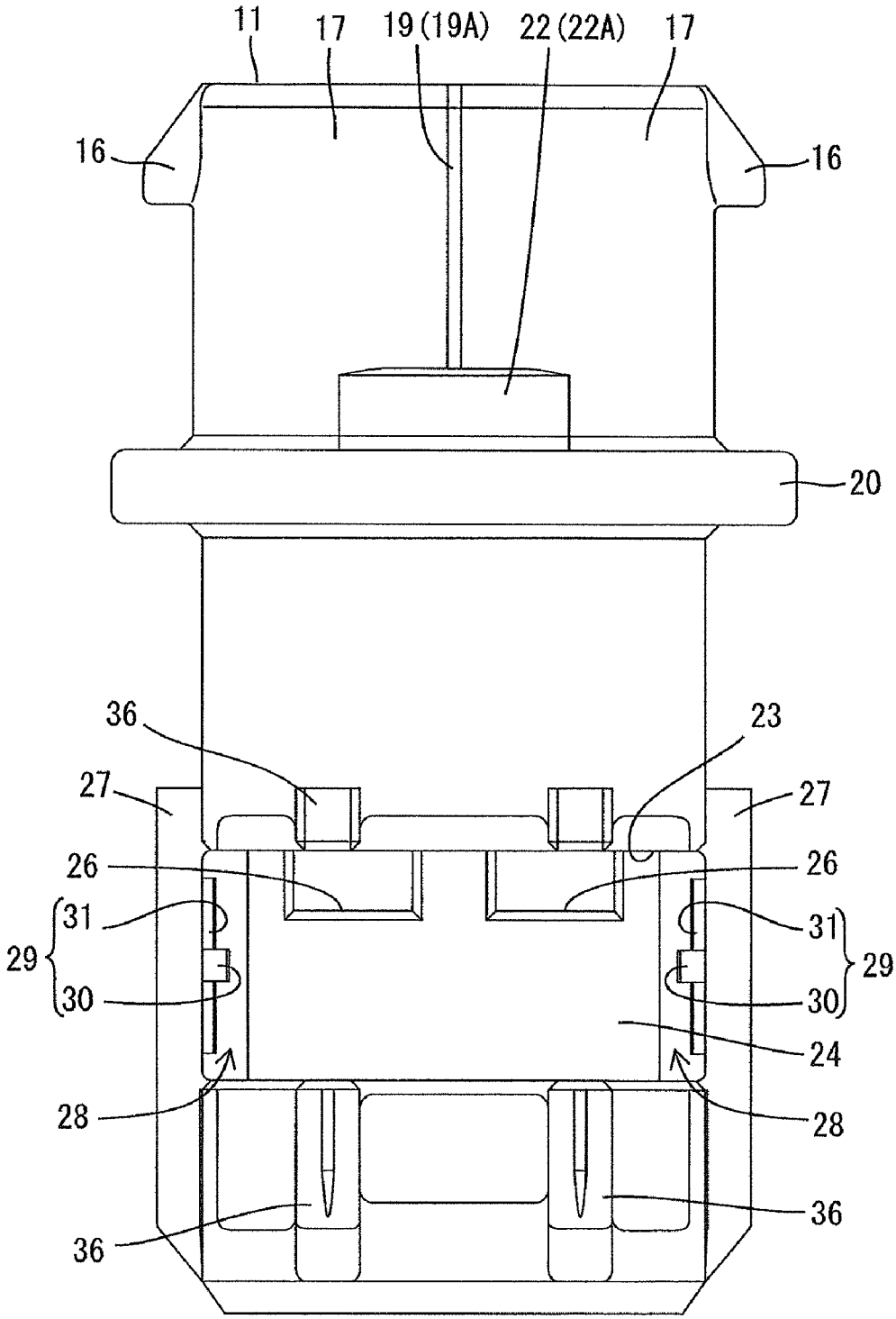
FIG. 9 is a plan view of the inner housing.
Figure 10:
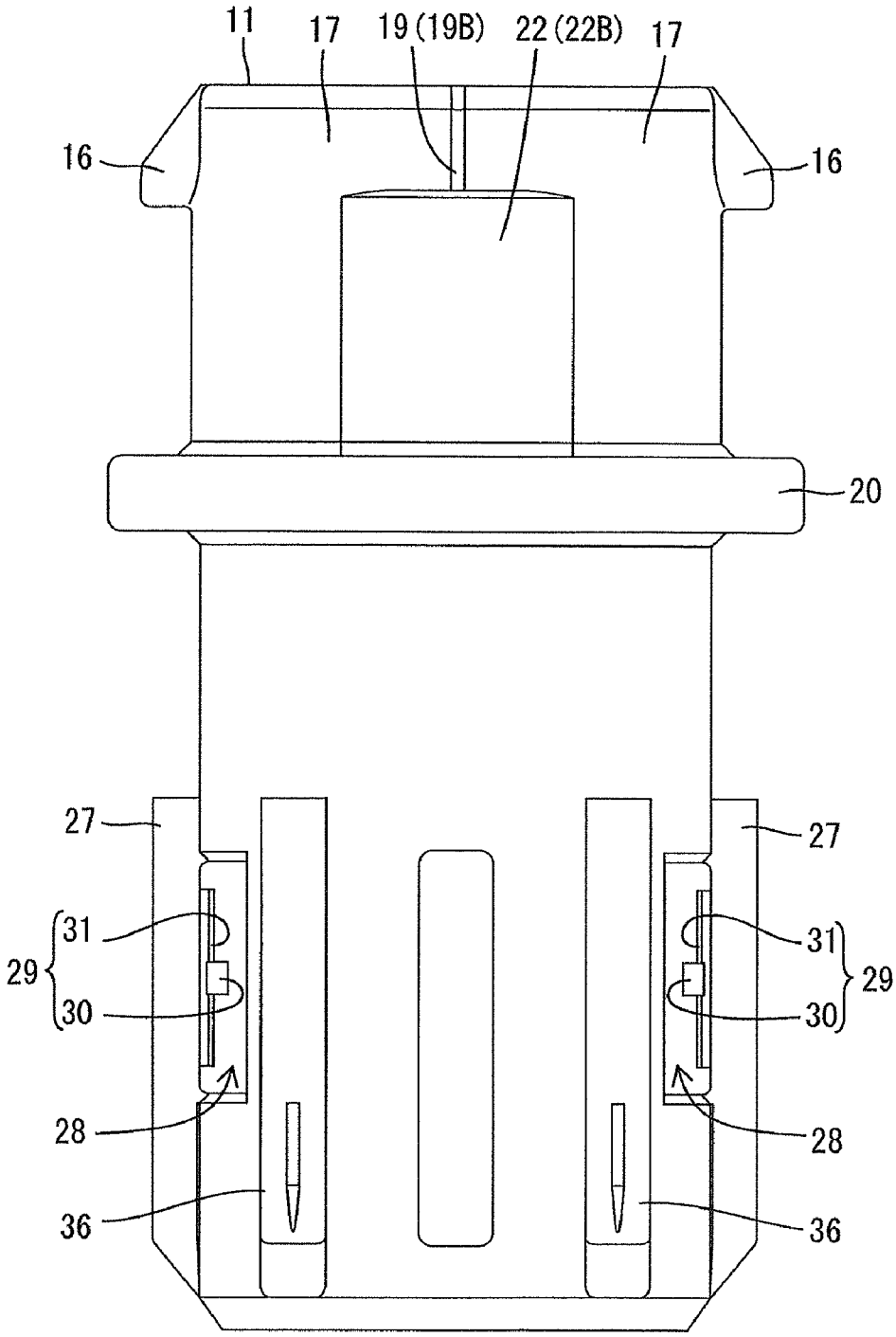
FIG. 10 is a bottom view of the inner housing.
Figure 11:
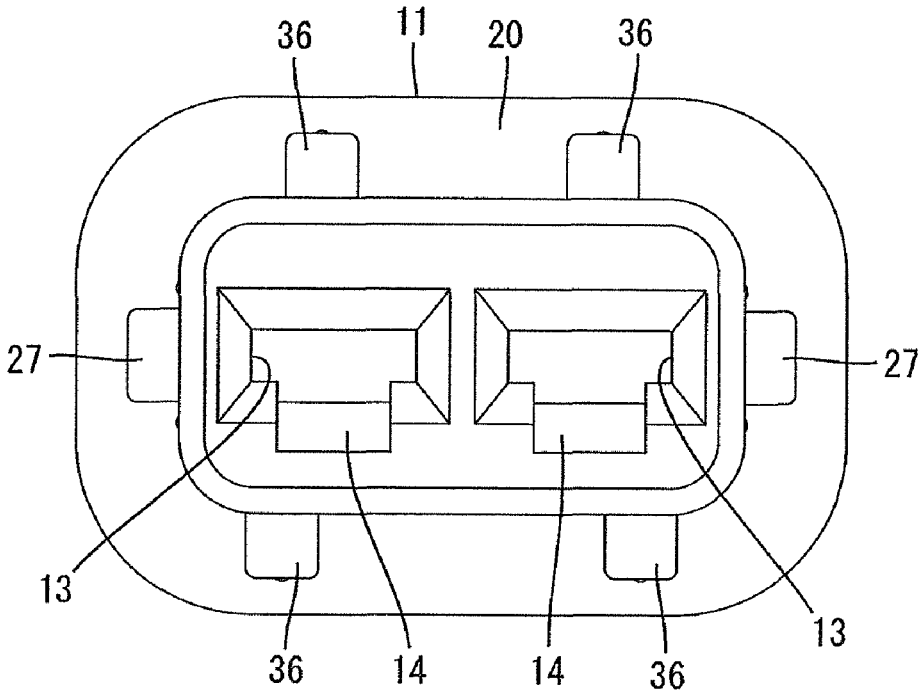
FIG. 11 is a front view of the inner housing.

As shown in FIGS. 8 through 10, two inner locks 16 project widthwise at a rear end of the inner housing 11.

Two cylindrical towers 17 are formed at a rear part of the inner housing 11 and are arranged widthwise. The sealing holes 15 are disposed inside each tower 17. A joining portion 18 is formed at the center of the rear part of the inner housing 11 and joins the adjacent towers 17. The joining portion 18 is a thin vertical wall that partitions the adjacent sealing holes 15 from each other.

The space between the adjacent towers 17 is partitioned with circular peripheral surfaces of the towers 17 to form concavities 19 that open up and down like a trumpet in a sectional view. The upper and lower concavities 19 are constructed that their lengths (same as depth) from an open end at the rear of the tower 17 to an inner end are different from each other. More specifically the upper concavity 19A is longer than the lower concavity 19B. Front and rear ends of the lower concavity 19B are coincident with front and rear ends of the inner locks 16. The extended length of the upper concavity 19A is two to three times longer than the lower concavity 19B.

A flange 20 projects from the outer surface of the inner housing 11 and extends around the entire periphery of the inner housing 11. A wide ring-shaped elastic member 90 is fit on the outer surface of the inner housing 11 rearward of the flange portion 20 so that the front surface of the elastic member 90 contacts a first contact surface 21 on the rear of the flange 20. Upper and lower thick portions 22 are formed between the towers 17 of the inner housing 11 and extend from the inner end of the concavity to the rear end of the flange 20. The lower thick portion 22B is two to three times longer than the upper thick portion 22A.

A mounting hole 23 is formed through the outer surface of the inner housing 11 and can receive a retainer 60 from above. A concave space 24 (see FIG. 9) is formed on an upper surface and both side surfaces of the inner housing 11 at positions corresponding to the mounting hole 23 by stepping down the concave space 24. A thin wall 25 (see FIG. 23) is formed on a bottom of the concave space 24 and partitions the cavities 13 from the retainer 60. Two approximately rectangular insertion holes 26 (FIG. 9) are formed through the upper thin wall 25 and can receive a removal prevention part 63. The insertion holes 26 communicate with the respective cavities 13.

Two bridges 27 are formed on both side surfaces of the inner housing 11 and straddle the mounting hole 23. Each bridge 27 bulges out from both side surfaces of the inner housing 11 and extends longitudinally. A penetration space 28 (FIG. 9) is formed at an inner side of each bridge 27 and defines both ends of the mounting hole 23 in the width direction.

A longitudinally extending rib-shaped locking projection 29 projects from an inner surface of each bridge 27. The locking projection 29 includes a first lock 30 at a central portion of each bridge 27 in the longitudinal direction thereof and a second lock 31 disposed at both sides of the first lock 30. The first lock 30 projects farther than the second lock 31.

Figure 20:
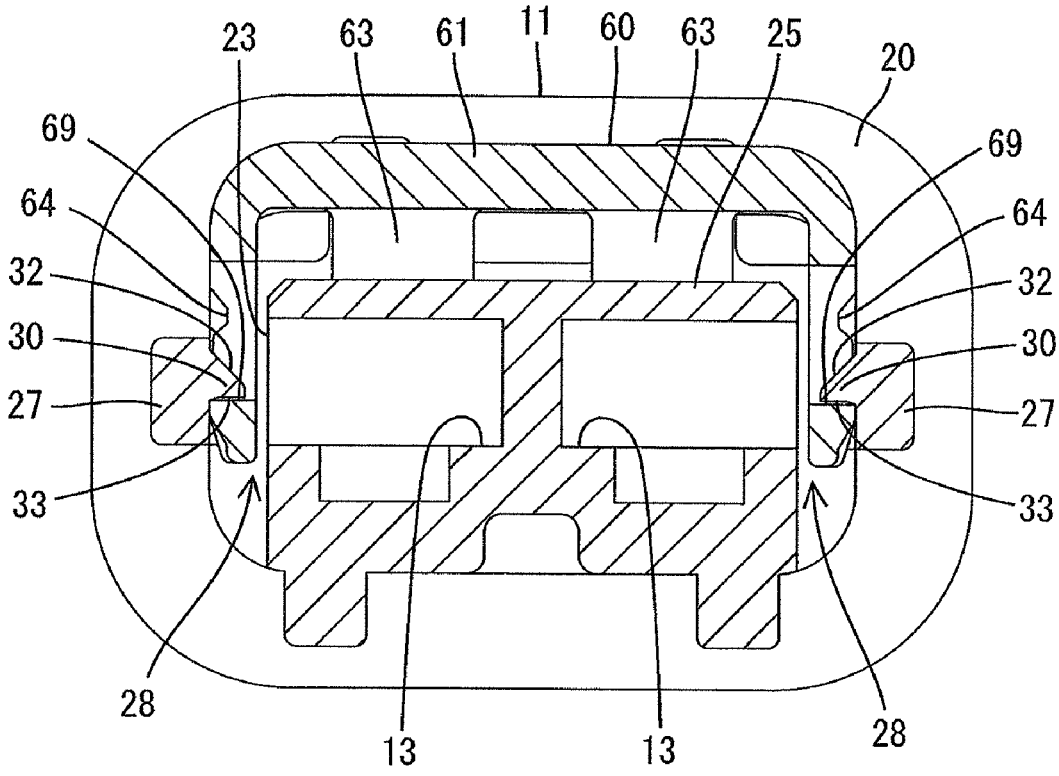
FIG. 20 is a sectional view taken along a line of A-A of FIG. 19.
Figure 21:
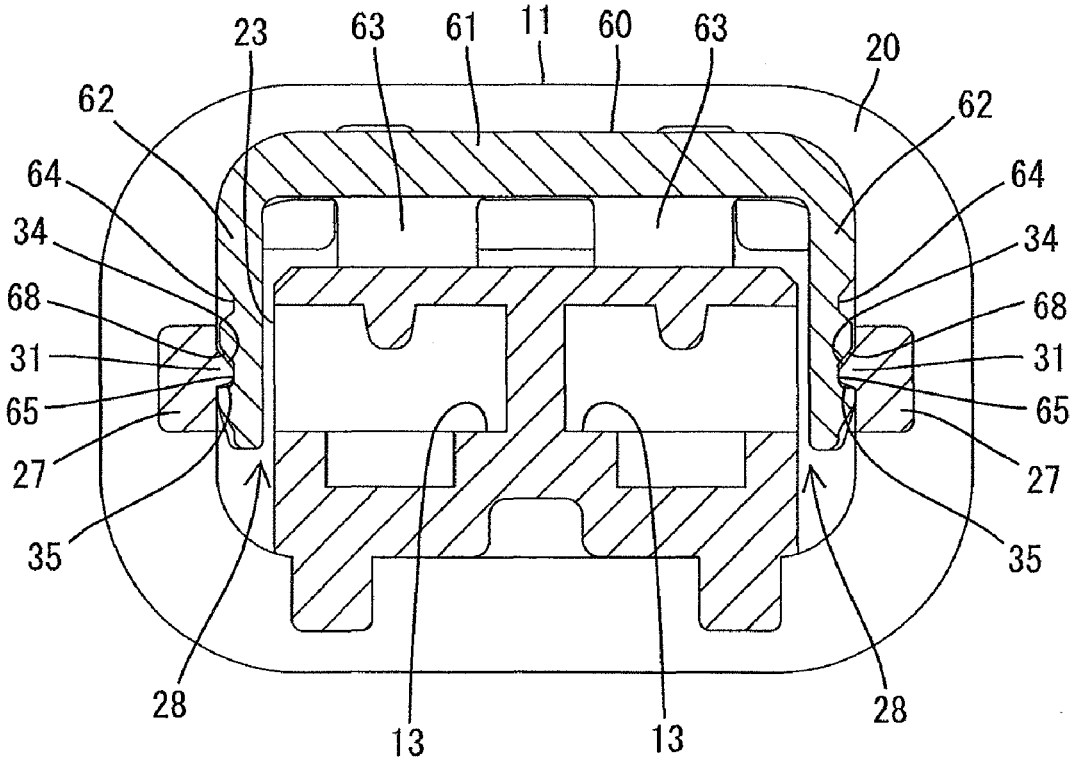
FIG. 21 is a sectional view taken along a line of B-B of FIG. 19.

As shown in FIG. 20, a third slope 32 is formed on an upper surface of the first lock 30 (forward surface in the direction in which retainer 60 is mounted) and inclines along the direction in which retainer 60 is mounted. A second locking surface 33 is formed on a lower surface of the first lock 30 (forward surface in the direction in which retainer 60 is drawn out) and is approximately orthogonal to the directions in which retainer 60 is mounted and drawn out. As shown in FIG. 21, a fourth slope 34 is formed on an upper surface of the second lock 31 and inclines along the direction in which retainer 60 is mounted. A second slope 35 is formed on a lower surface of the second lock 31 and inclines along the direction in which retainer 60 is drawn out. The fourth slope 34 is formed as a pair disposed at both sides of the third slope 32. The second slope 35 is formed as a pair disposed at both sides of the second locking surface 33. The inner ends of the third slope 32 and the second locking surface 33 are disposed inward from the inner ends of the fourth slope 34 and second slopes 35.

More specifically, the third and fourth slopes 32 and 34 are tapered and gradually open out toward their upper ends. The second slope 35 is tapered and gradually opens out toward the lower end. The second locking surface 33 is a substantially flat horizontal surface.

Figure 2:
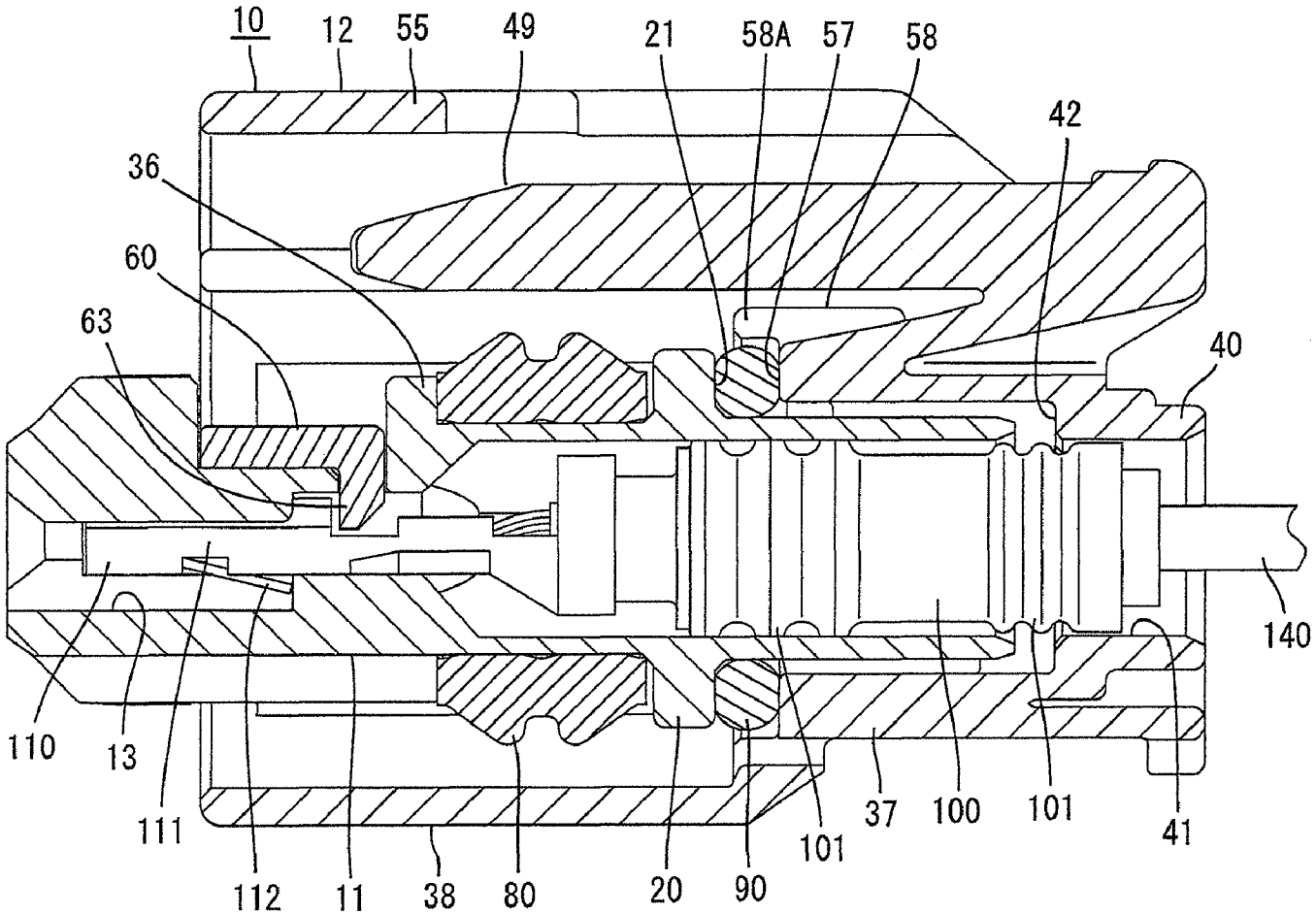
FIG. 2 is a sectional view of the connector.
Figure 3:
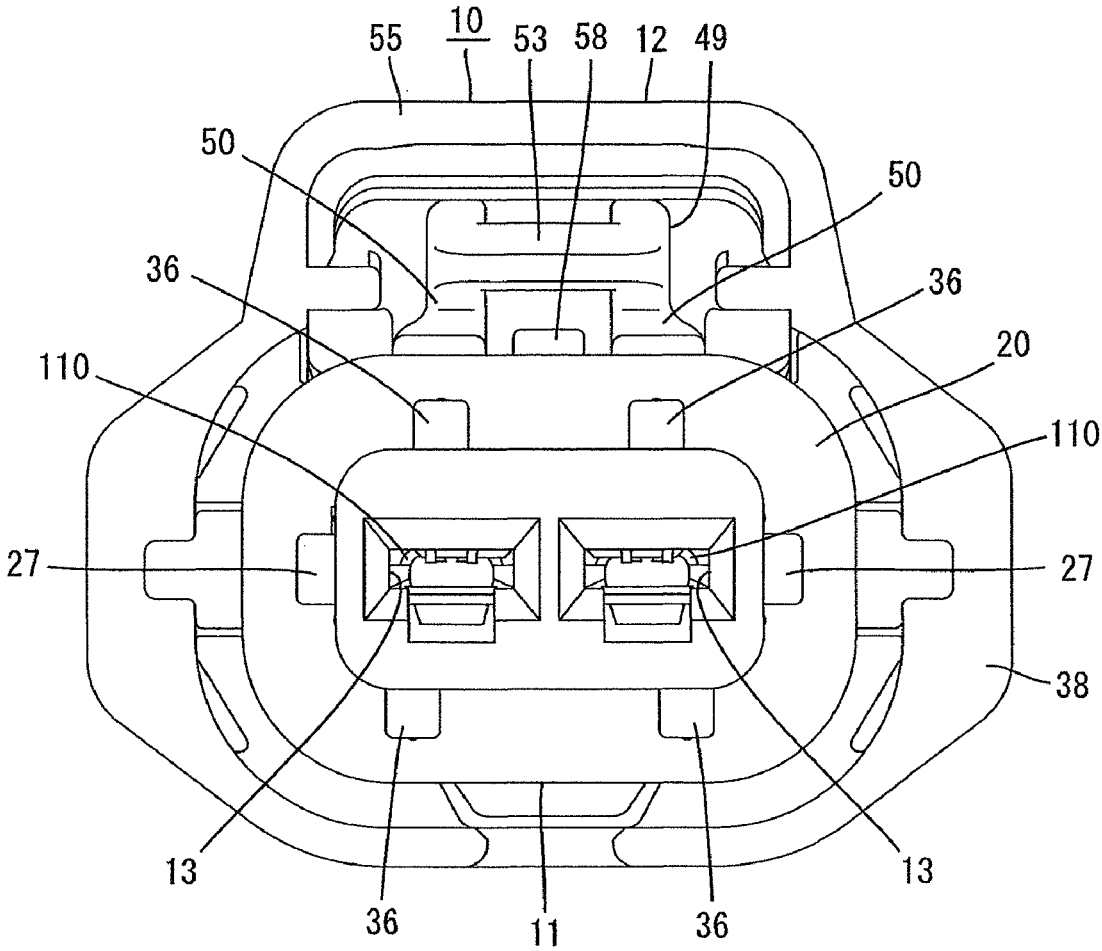
FIG. 3 is a front view of the connector.
Figure 4:
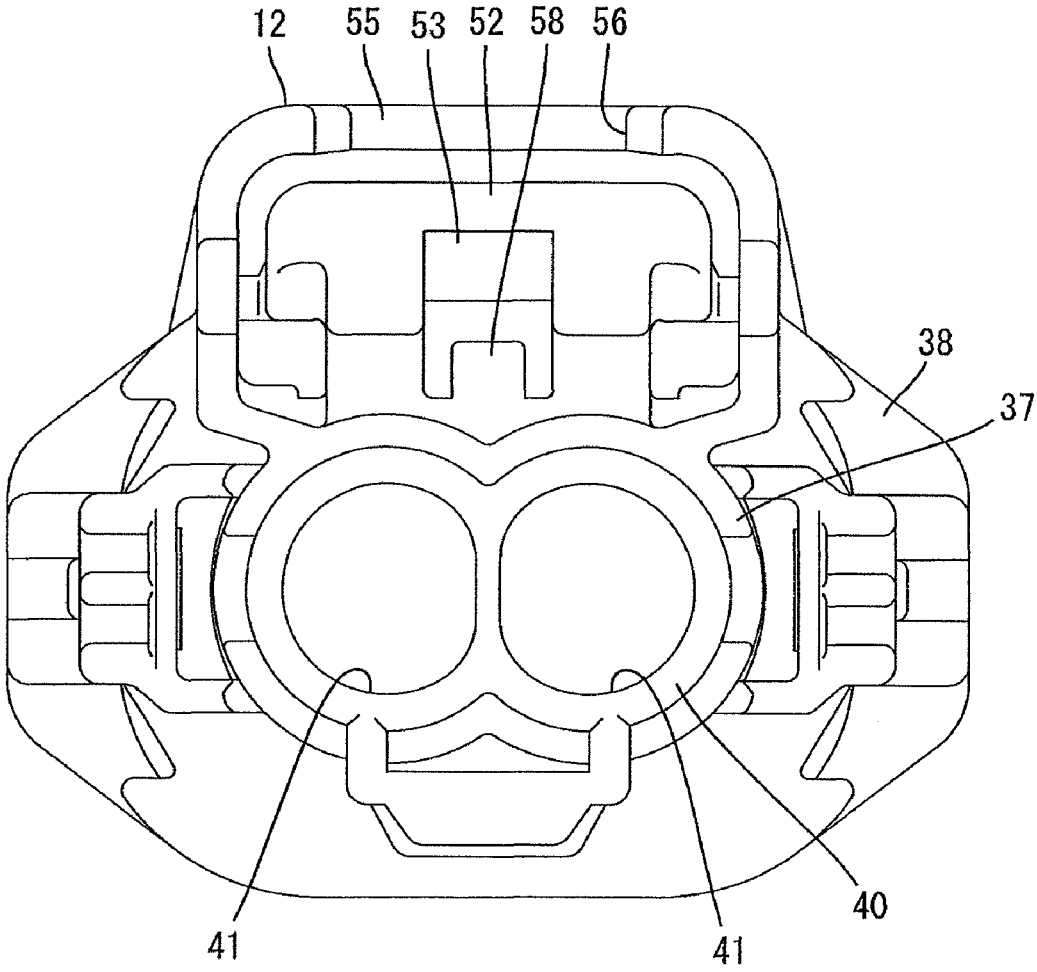
FIG. 4 is a rear view of an outer housing.
Figure 12:
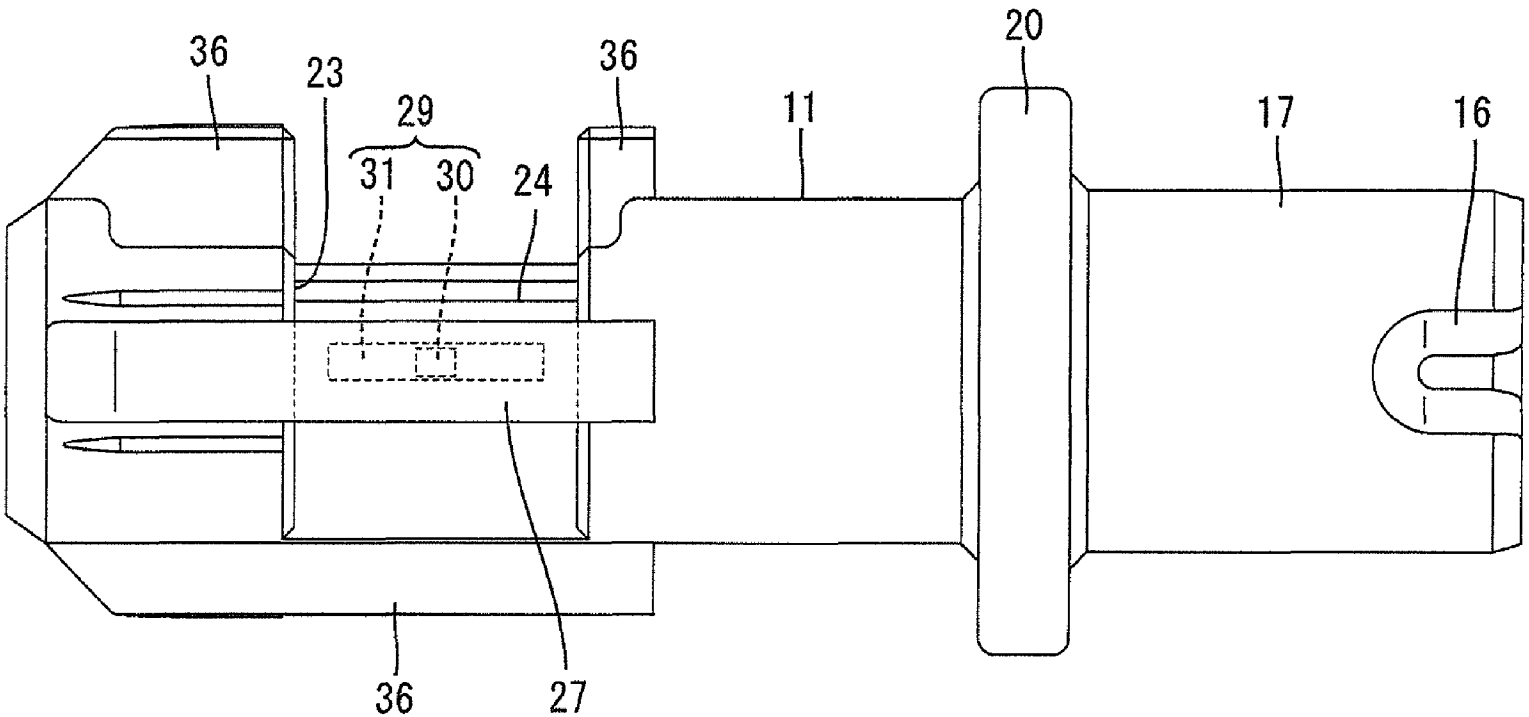
FIG. 12 is a side view of the inner housing.

As shown in FIG. 12, ribs 36 extend longitudinally on the upper and lower surfaces of the inner housing 11. Each rib 36 fits in an unshown receiving groove of the mating housing 120 to guide the housings 10 and 120 during a connecting operation. Additionally both housings 10 and 120 are prevented from being fit together erroneously. The upper rib 36 is divided into front and rear portions via an opening formed through the upper surface. As shown in FIG. 2, a ring-shaped sealing member 80 is fit on the inner housing 11. The sealing member 80 is made of rubber is disposed longitudinally at a predetermined position between the rib 36 and the flange 20.

Figure 13:
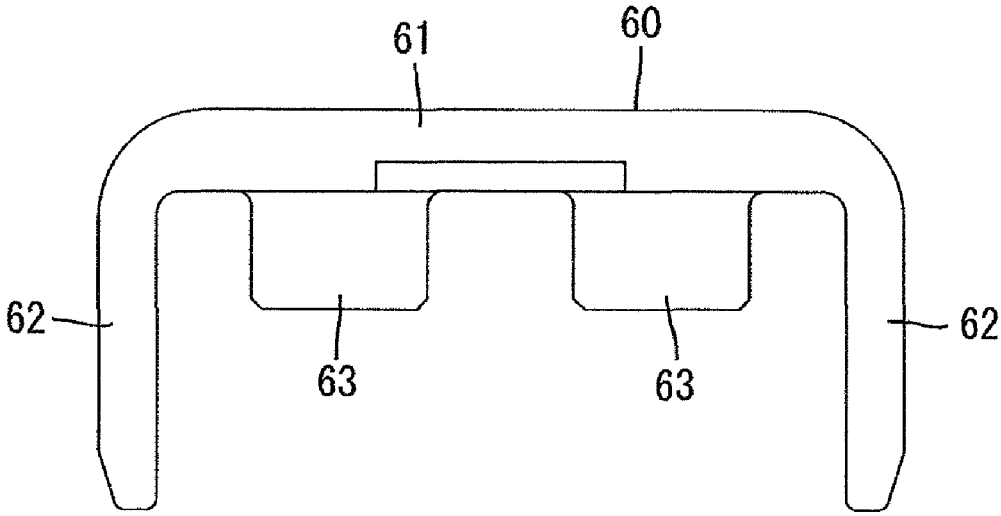
FIG. 13 is a front view of a retainer.

The retainer 60 is made of synthetic resin to define a wide body 61 and two substantially parallel elastic pieces 62 projected from widthwise ends of the body 61, as shown in FIG. 13. Thus, the retainer is substantially U-shaped. The retainer 60 is movable between a temporary locking position where the retainer 60 is mounted shallowly on the inner housing 11 and a main locking position where the retainer 60 is mounted deeply on the inner housing 11.

The body 61 is fit in the upper concave space 24 of the inner housing 11. At the main locking position, the body 61 is supported by the thin wall 25. Two removal prevention parts 63 project on a rear part of the lower surface of the body 61 at positions corresponding to the cavities 13 and can penetrate through the respective insertion holes 26. Each removal prevention part 63 is approximately rectangular in front view. The removal prevention part 63 is offset from the cavity 13 at the temporary locking position, thus allowing the terminal fitting 110 to be inserted into or removed from the cavity 13. The removal prevention part 63 is in the cavity at the main locking position, to prevent the terminal fitting 110 from being removed from the cavity 13.

Each elastic piece 62 is flexible widthwise about a root that is continuous with the body 61. The penetration space 28 of the inner housing 11 includes an insertion region into which the elastic piece 62 is inserted and a region inward from the insertion region in which the elastic piece 62 flexes.

Figure 14:
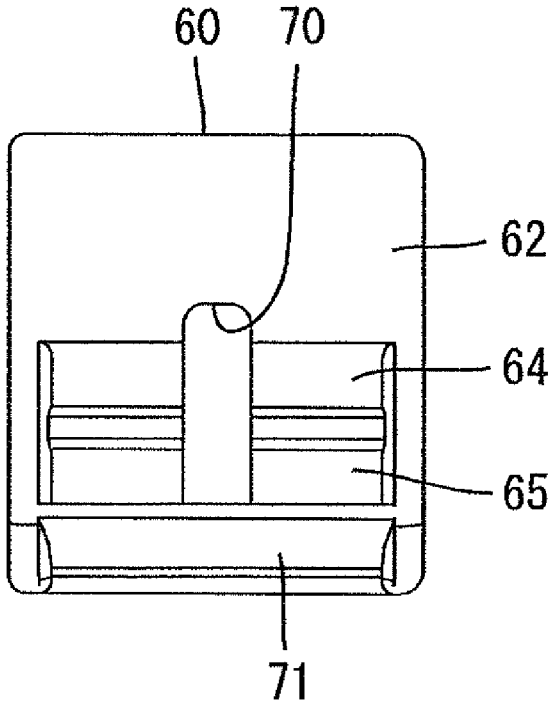
FIG. 14 is a side view of the retainer.
Figure 15:
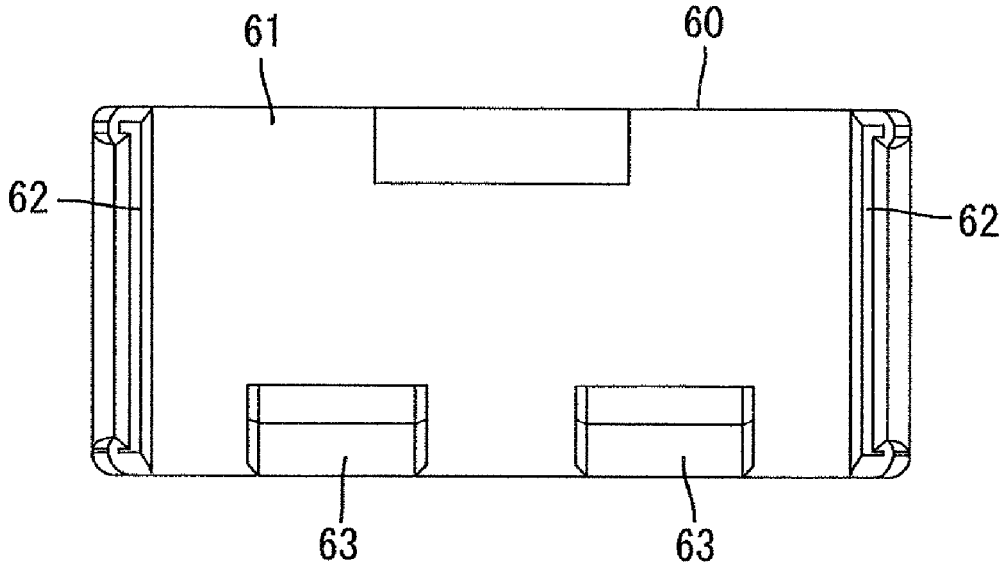
FIG. 15 is a bottom view of the retainer

As shown in FIG. 14, a main locking concavity 64 and a temporary locking concavity 65 are arranged vertically on an outer surface of each elastic piece 62 and can receive the locking projection 29. The main locking concavity 64 is above the temporary locking concavity 65. A guide concavity 71 is formed on the outer surface of a distal end of each elastic piece 62 at a position below the temporary locking concavity 65 for guiding an insertion of each elastic piece 62 into the penetration space 28.

Figure 24:
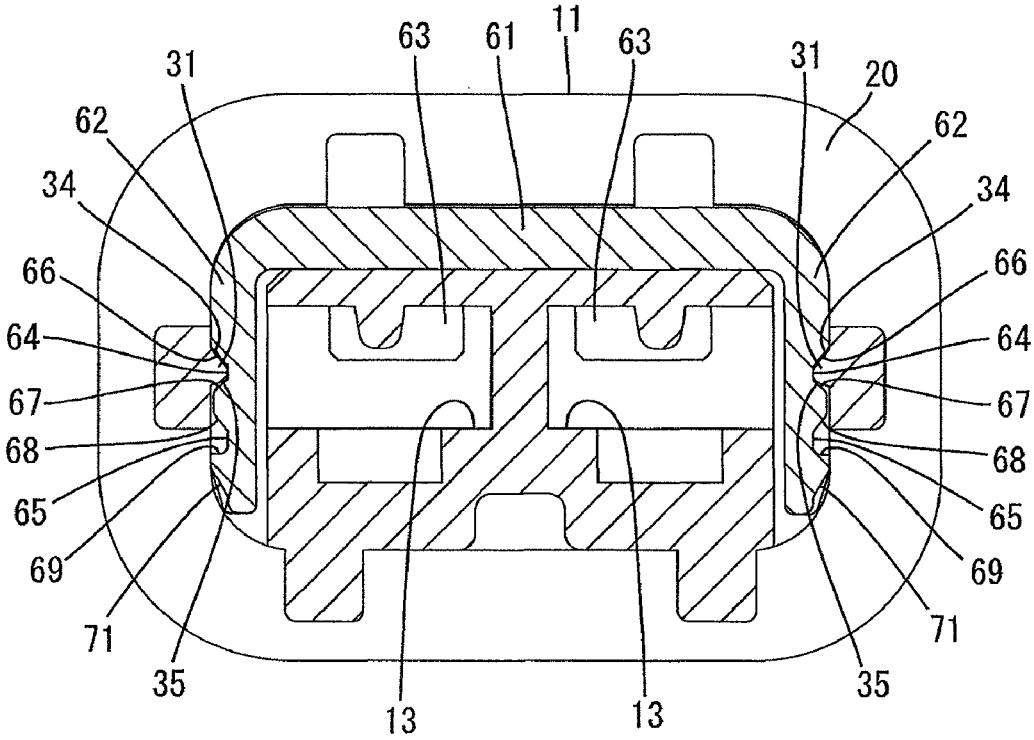
FIG. 24 is a sectional view taken along a line of D-D of FIG. 22.

The main and temporary locking concavities 64 and 65 are bottomed grooves that extend longitudinally from the front end of each elastic piece 62 to the rear end thereof and have almost equal depths. As shown in FIG. 24, a fifth slope 66 is formed on an upper surface of the main locking concavity 64 (forward surface in the direction in which retainer 60 is mounted) and inclines along the direction in which retainer 60 is mounted. A first slope 67 is formed on a lower surface of the main locking concavity 64 (forward surface in direction in which retainer 60 is drawn out) and inclines along the direction in which retainer 60 is drawn out. A sixth slope 68 is formed on an upper surface of the temporary locking concavity 65 and inclines along the direction in which retainer 60 is mounted. A first locking surface 69 is formed on a lower surface of the temporary locking concavity 65 and is substantially orthogonal to the directions in which retainer 60 is mounted and drawn out.

The fifth and sixth slopes 66 and 68 are tapered to open gradually out toward their upper ends. The first slope 67 is tapered to open gradually out toward the lower end thereof. The first locking surface 69 is substantially flat and horizontal. Inclinations of the fifth and sixth slopes 66 and 68 are almost equal.

Figure 23:
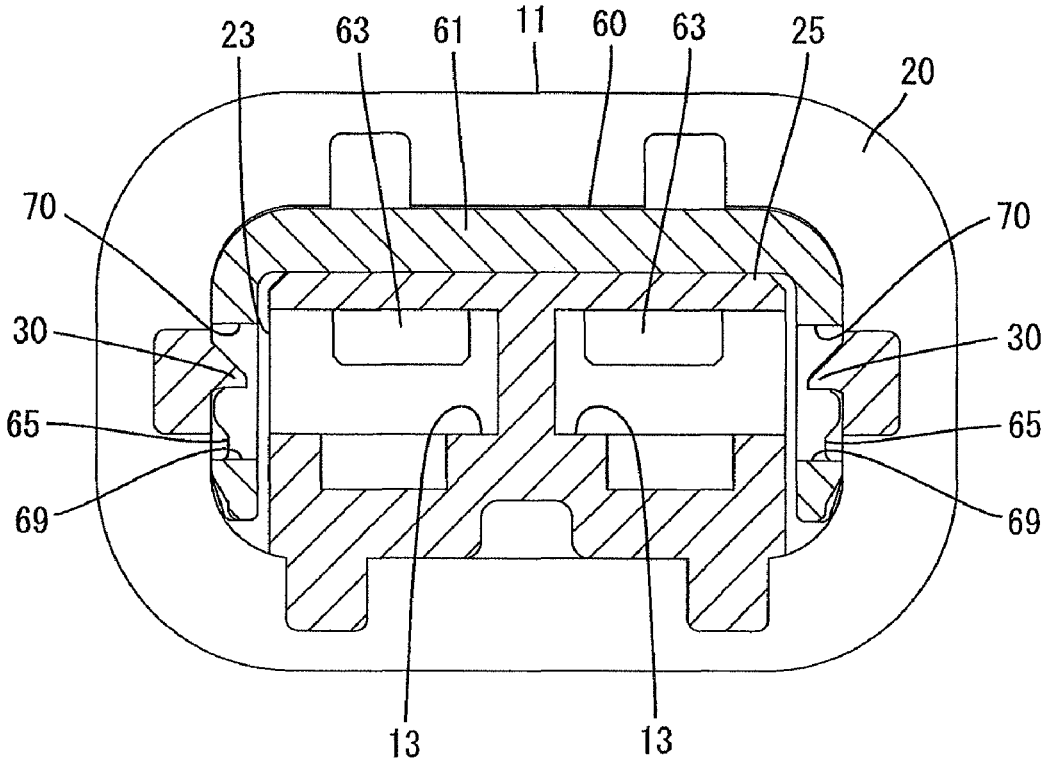
FIG. 23 is a sectional view taken along a line of C-C of FIG. 22.

An escape hole 70 penetrates each elastic piece 62 at a position between the main and temporary locking concavities 64 and 65 for receiving the first lock 30 of the locking projection 29 during movement of the retainer 60. As shown in FIGS. 14 and 23, the escape hole 70 is a vertically long slit in which the locking projection 29 of the retainer 60 is moved. The lower end of the escape hole 70 is partitioned by the first locking surface 69 of the temporary locking concavity 65. The upper end of the escape hole 70 is slightly above the upper end of the main locking concavity 64. The escape hole 70 is at a central portion of each elastic piece 62 in the longitudinal direction thereof and is formed across the central portion of the main and temporary locking concavities 64 and 65 in the longitudinal direction thereof. Therefore each of the main and temporary locking concavities 64 and 65 is divided into front and rear portions through the escape hole 70.

Figure 6:
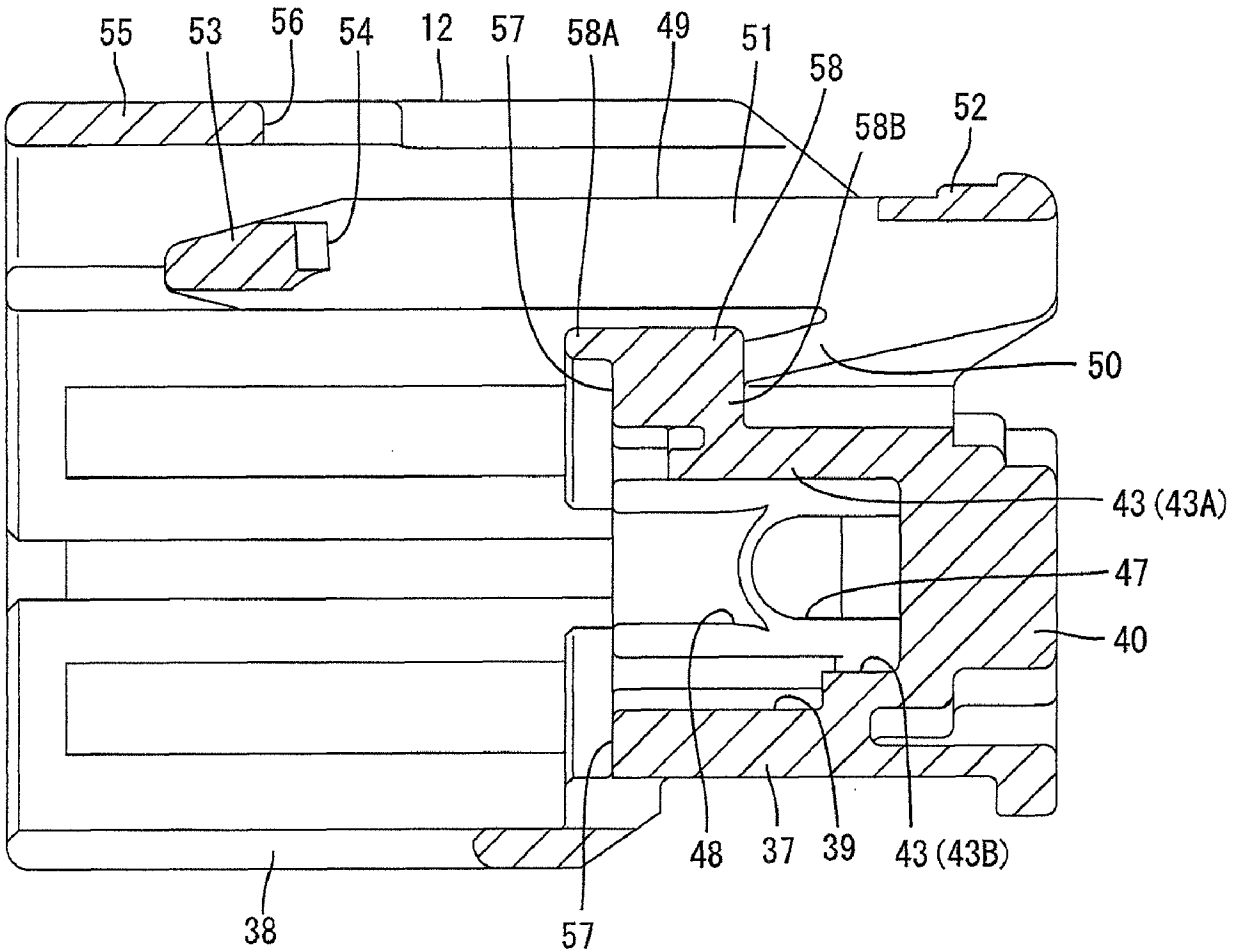
FIG. 6 is a sectional view of the outer housing.
Figure 7:
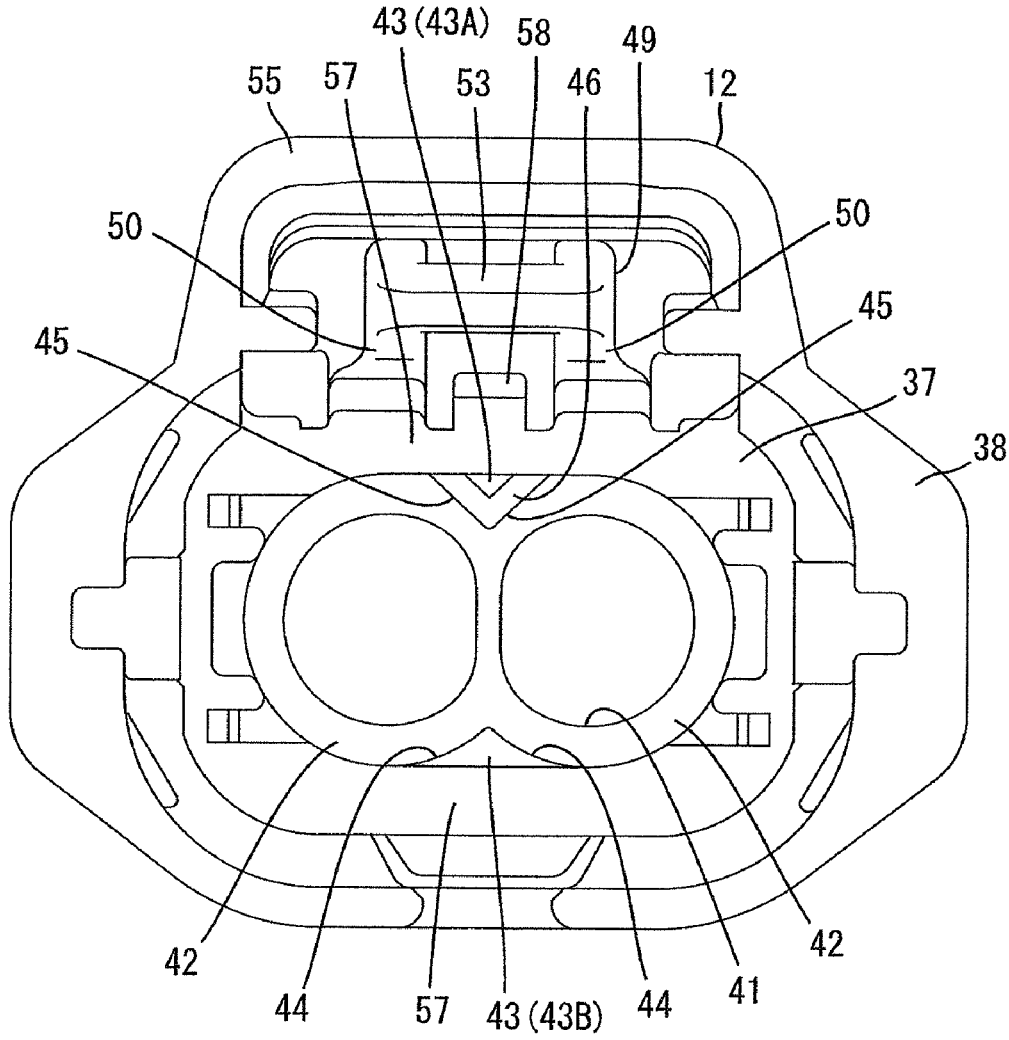
FIG. 7 is a front view of the outer housing.

The outer housing 12 is made of synthetic resin. As shown in FIGS. 6 and 7, the outer housing 12 has a tubular body 37 and a tubular fit-on part 38. The tubular fit-in part 38 is larger than the body 37 and projects forward from the body 37.

A forwardly open receiving portion 39 is formed on the body 37 of the outer housing 12 for receiving each tower 17. An opposed tubular portion 40 projects at a rear part of the body 37 of the outer housing 12 opposed to the rear end of each tower 17 fit in the receiving portion 39. The opposed tubular portion 40 defines a double-barreled tube corresponding to each tower 17. An opposed sealing hole 41 is formed inside the opposed tubular portion 40 and communicates with the sealing hole 15. As shown in FIG. 2, the rear portion of the rubber stopper 100 closely contacts the opposed sealing hole 41 and liquid-tightly seals the opposed sealing hole 41. The rubber stopper 100 is fit on the sealing hole 15 and the opposed sealing hole 41 and straddles both holes 15 and 41. Lips 101 extend around the periphery of the rubber stopper 100 for elastically closely contacting both holes 15 and 41.

Figure 16:
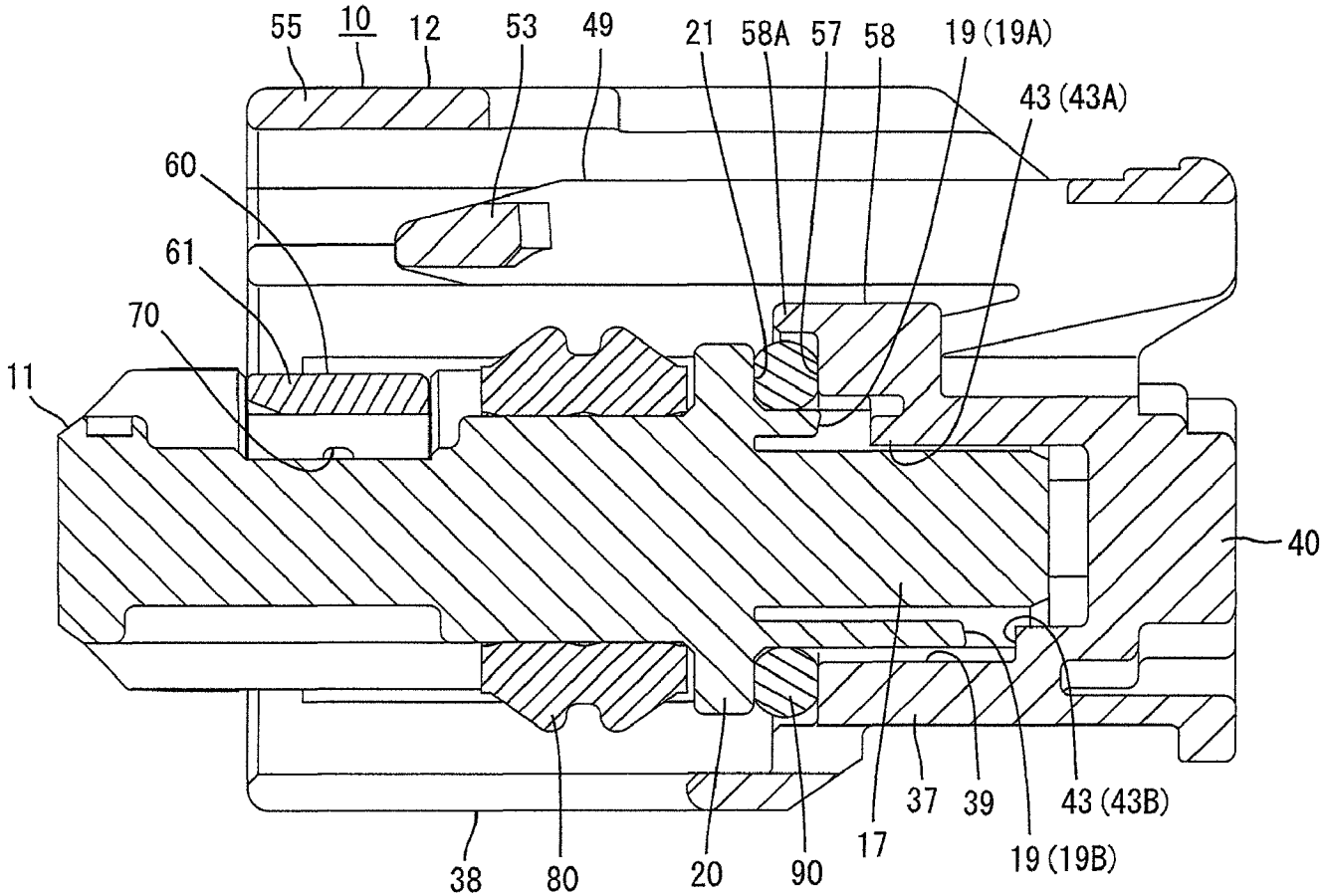
FIG. 16 is a sectional view showing a state in which the inner housing is normally mounted in the outer housing.

A step 42 extends radially at a front edge of the opposed tubular portion 40 and is continuous with an inner peripheral surface of the receiving portion 39. Rib-shaped convexities 43 are formed at upper and lower sides of an inner surface of the receiving portion 39 and extend forward a predetermined length from the step 42. The convexities 43 are disposed at widthwise central portions of the body 37. The upper and lower convexities 43 are inserted into the upper and lower concavities 19 in a normal depth when each tower 17 is fit normally in the receiving portion 39, i.e., when the outer housing 12 is fit normally on the inner housing 11. At this time, an outer surface of each convexity 43 is spaced at a certain interval from an inner surface of each concavity 19 (see FIG. 16).

As shown in FIG. 6, the upper and lower convexities 43 extend different lengths forward from the stepped surface 42. More specifically, the extended length of the upper convexity 43A is long in correspondence to the upper concavity 19A, whereas the extended length of the lower convexity 43B is shorter than that of the upper convexity 43A in correspondence to the lower concavity 19B. Thus, the front end of the lower convexity 43B is rearward from the front end of the upper convexity 43A. The front end of the lower convexity 43B is at a position where the body 37 of the outer housing 12 and the fit-on tubular part 38 are connected to each other. The extended length of the upper convexity 43A is two to three times longer than the lower convexity 43B.

As shown in FIG. 7, the lower convexity 43B is open like a trumpet toward the lower end in a sectional view and has two circular arc surfaces 44 with sharp leading ends that become substantially parallel with the inner surface of the concavity 19 when the towers 17 are fit normally in the receiving portion 39. On the other hand, the upper convexity 43A is sectionally triangular and tapers open toward the upper end with straight opposite sides 45 and an open angle corresponding to the concavity 19A when the towers 17 are fit normally in the receiving portion 39. The upper convexity 43A is forwardly convex and interferes with the lower concavity 19B when an erroneous fit-on is performed. An approximately V-shaped rib-like reinforcement 46 is formed along both opposite sides 45 at the front edge of the upper convexity 43A.

Two inner locking receiving portions 47 penetration through the side walls of the body 37 of the outer housing 12 and elastically receive an inner locking portion 16 when each tower 17 is fit normally in the receiving portion 39. Forwardly open guide grooves 48 are formed on the inner surfaces of both sides walls of the body 37 of the outer housing 12 for guiding the inner locks 16 into the inner locking receiving portion 47. Engagement of the inner locks 16 in the inner locking receiving portion 47 prevents separation of the inner and outer housing 11 and 12.

A locking arm 49 projects from a widthwise central portion of an upper surface of an upper wall of the body 37 of the outer housing 12. More specifically the locking arm 49 has two legs 50 that extend diagonally up and rearward from the front end of the body 37, two arms 51 that extend forward almost straight from upper ends of the legs 50, an operation portion 52 connected to rear ends of both arms 51, and a body 53 connected to front ends of both arms 51. A locking groove 54 is formed between the arms 51, forward from the operation portion 52 and rearward from the body 53 and can receive the lock of the mating housing 120. The lock of the mating housing 120 interferes with the body 53 while fitting the housing 10 and the mating housing 120 together, and the arms 51 deform down about the legs 50. The arms 51 return resiliently to their original state when the housing 10 and the mating housing 120 are fit normally together so that the lock fits in the locking groove 54 to hold the housing 10 and the mating housing 120 together. The operation portion 52 can pressed to separate the lock from the locking groove 54 so that the housing 10 and the mating housing 120 can be separated.

Figure 5:
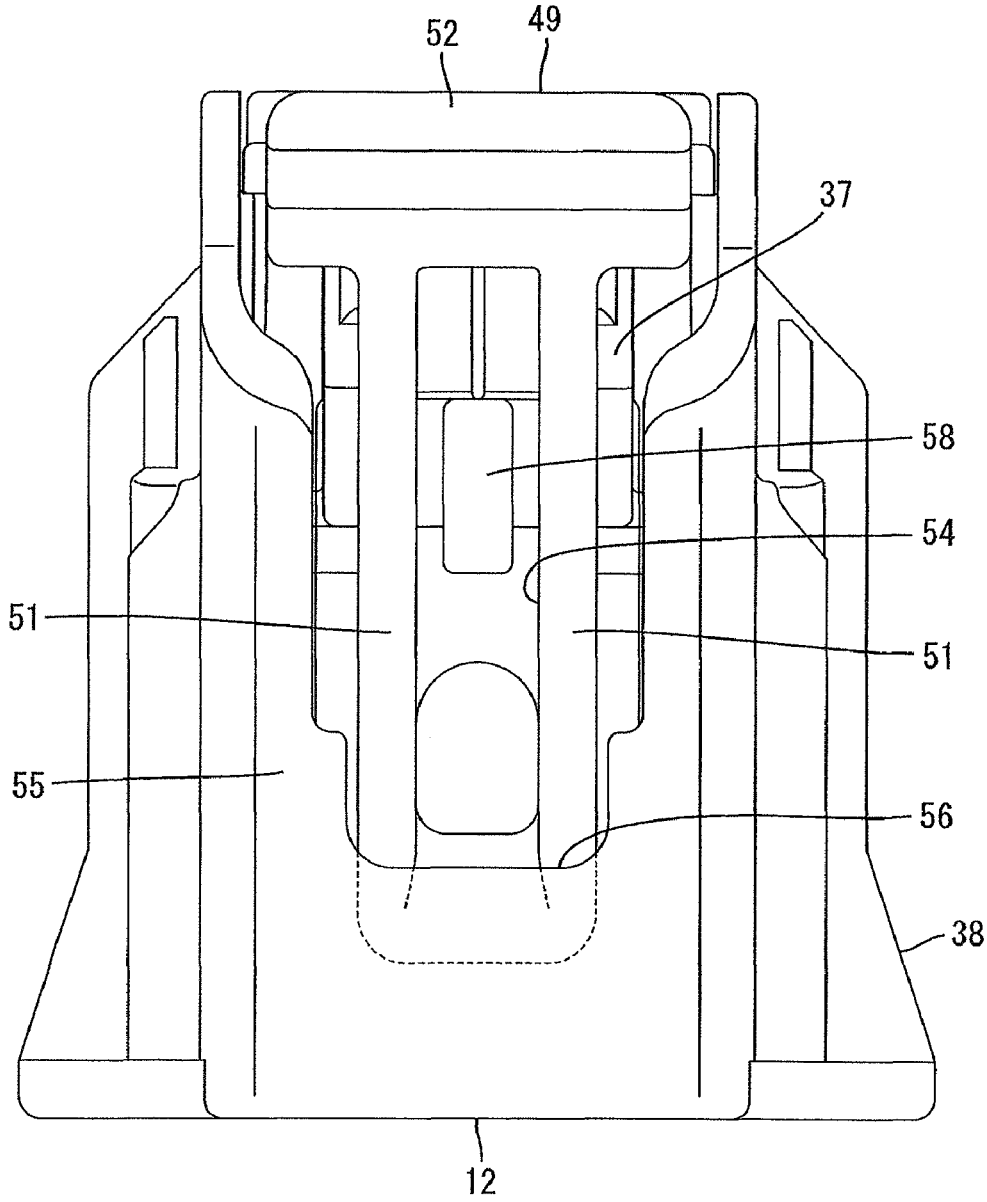
FIG. 5 is a plan view of the outer housing.

A bulge 55 bulges out from an upper wall of the fit-on tubular part 38 and the locking arm 49 is disposed inside the bulge 55. As shown in FIG. 5, a window 56 is formed on an upper wall of the bulge 55 to expose the locking arm 49 visibly.

Second contact surfaces 57 extend radially out at upper and lower positions of the front edge of the body 37 of the outer housing 12 for contacting the elastic member 90 from the rear. The second contact surfaces 57 of the body 37 are parallel to and opposed to the first contact surface 21 of the flange 20 to provide a space for sandwiching the elastic member 90 between the first and second contact surfaces 21 and 57.

The elastic member 90 is sandwiched between the first contact surface 21 of the flange portion 20 and the second contact surface 57 of the body 37 of the outer housing 12 in a compressed state when the housing 10 and the mating housing 120 are fit normally together. At this time, force for longitudinally separating the housing 10 and the mating housing 120 acts therebetween due to an elastic restoring force of the elastic member 90. Thus, the housings 10 and 120 are prevented from loosening.

A hold-down part 58 for suppressing outward elongation of the elastic member 90 projects on the upper surface of the upper wall of the body 37 of the outer housing 12. The hold-down part 58 has a raised portion 58B rising from the front end of the upper wall of the body 37 and a protrusion 58A projects forward from the upper end of the raised portion 58B. Thus, the hold-down part 58 is L-shaped in section. The protrusion 58A is spaced out from the elastic member 90 when the elastic member 90 is in an uncompressed state. However, the protrusion 58A contacts the elastic member 90 from a radially outward side and holds the elastic member 90 down when the elastic member 90 is in a highly compressed state.

The hold-down part 58 radially overlaps the locking arm 49 at a central part of the body 37 of the outer housing 12 in the width direction and is between the legs 50 of the locking arm 49 in a front view. The locking groove 54 of the locking arm 49 is above the hold-down part 58 so that the hold-down part 58 is visible through the locking groove 54.

Figure 18:
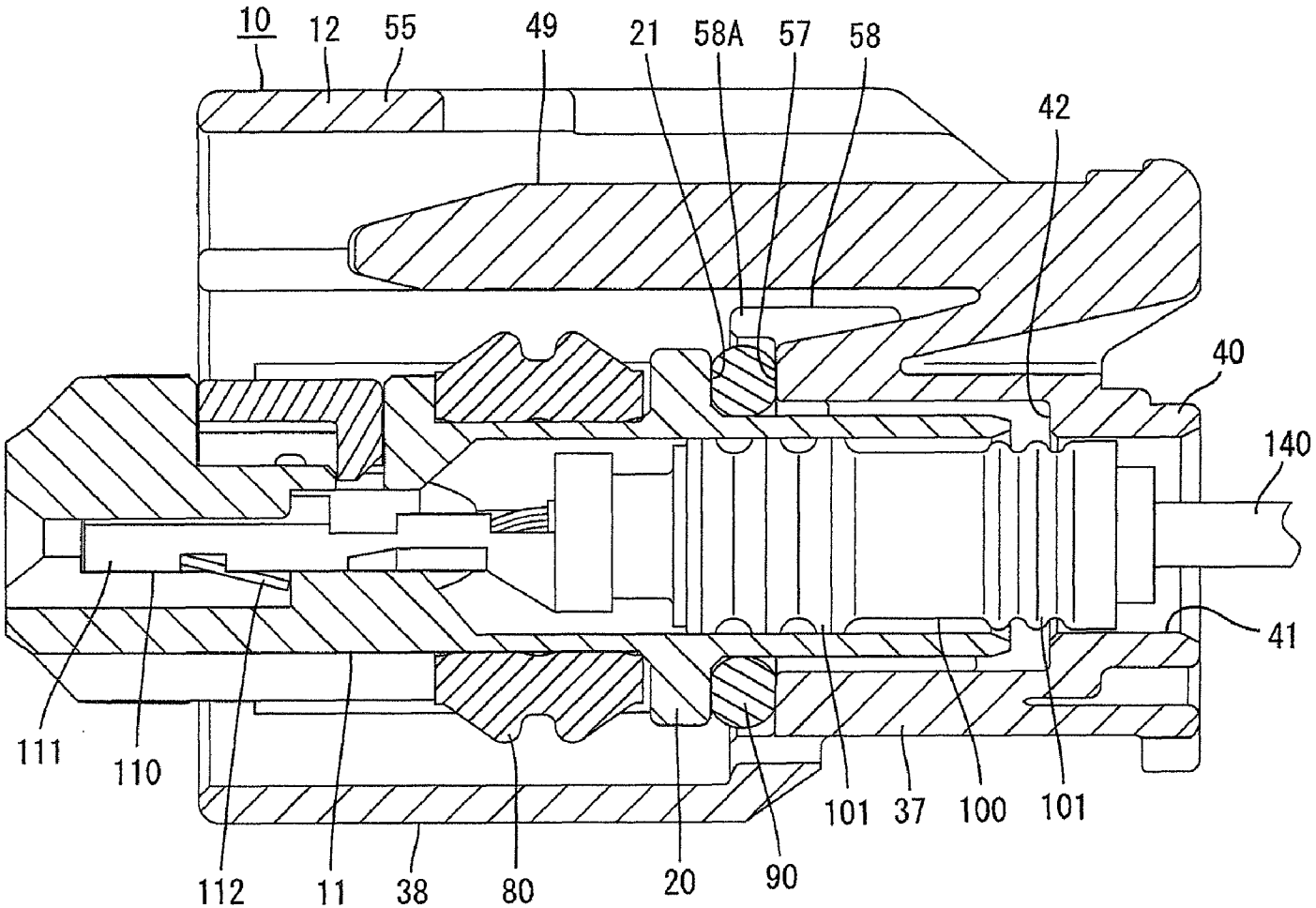
FIG. 18 is a sectional view of the connector when the retainer is disposed at a temporary locking position.
Figure 19:
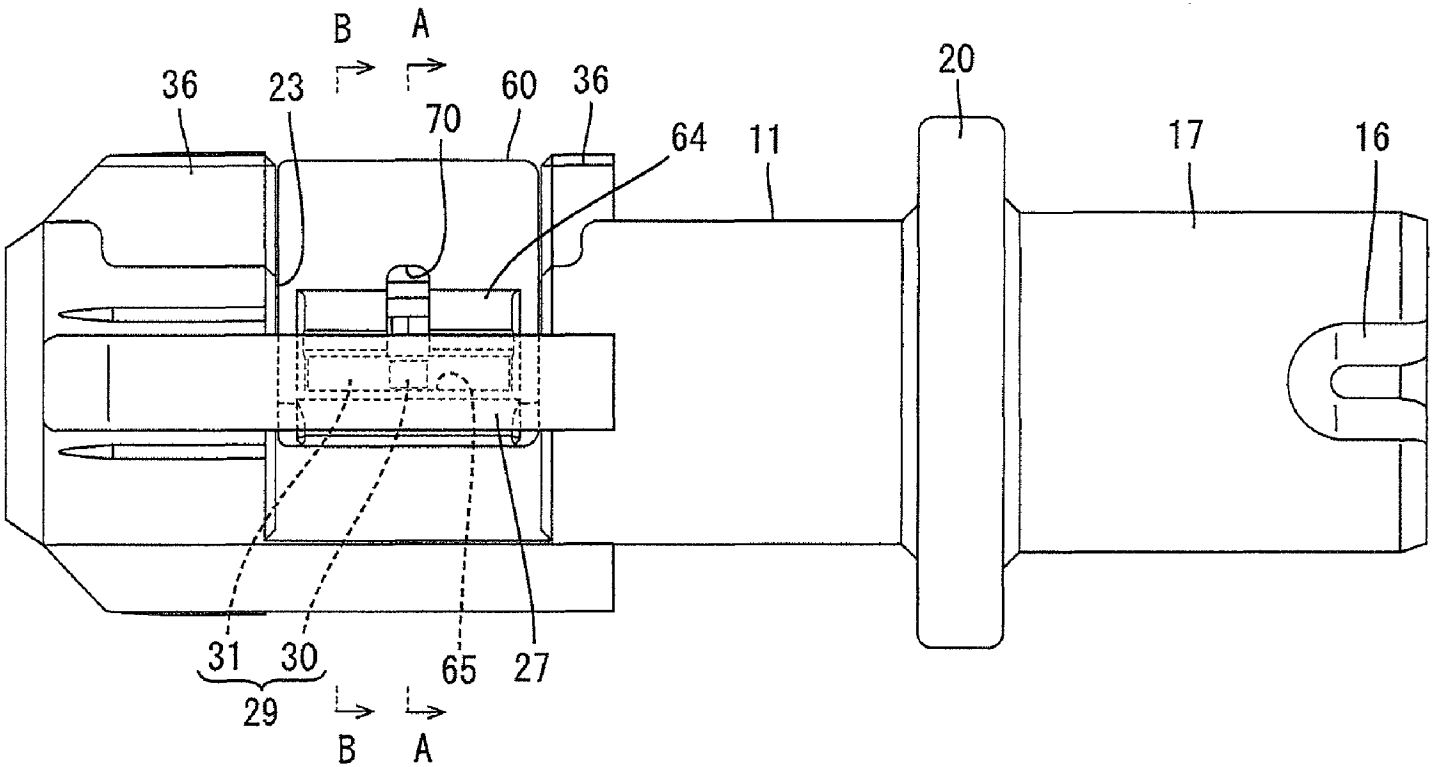
FIG. 19 is a side view of the inner housing when the retainer is disposed at the temporary locking position.

The retainer 60 is inserted into the mounting hole 23 of the inner housing 11 and held at the temporary locking position. At the temporary locking position, the outer surface of the body 61 is continuous and flush with that of the inner housing 11 (see FIG. 18), and the second lock 31 of the locking projection 29 of the inner housing 11 is fit elastically into the temporary locking concavity 65 of the retainer 60 (see FIG. 19). At this time, as shown in FIG. 20, the second locking surface 33 of the locking projection 29 is disposed so that the first and second locking surfaces 69 and 33 of the temporary locking concavity 65 are almost orthogonal to the direction in which the retainer 60 is drawn out. Thus, the retainer 60 is prevented from being removed from the inner housing 11. At the temporary locking position, the first lock 30 of the locking projection 29 penetrates into the escape hole 70 and thus cannot interfere with the retainer 60, and the fourth slope 34 of the locking projection 29 is disposed substantially along the surface direction of the sixth slope 68 of the temporary locking concavity 65 with the second slope 35 of the locking projection 29 being spaced at a certain gap from the first locking surface 69 of the temporary locking concavity 65, as shown in FIG. 21.

Figure 22:
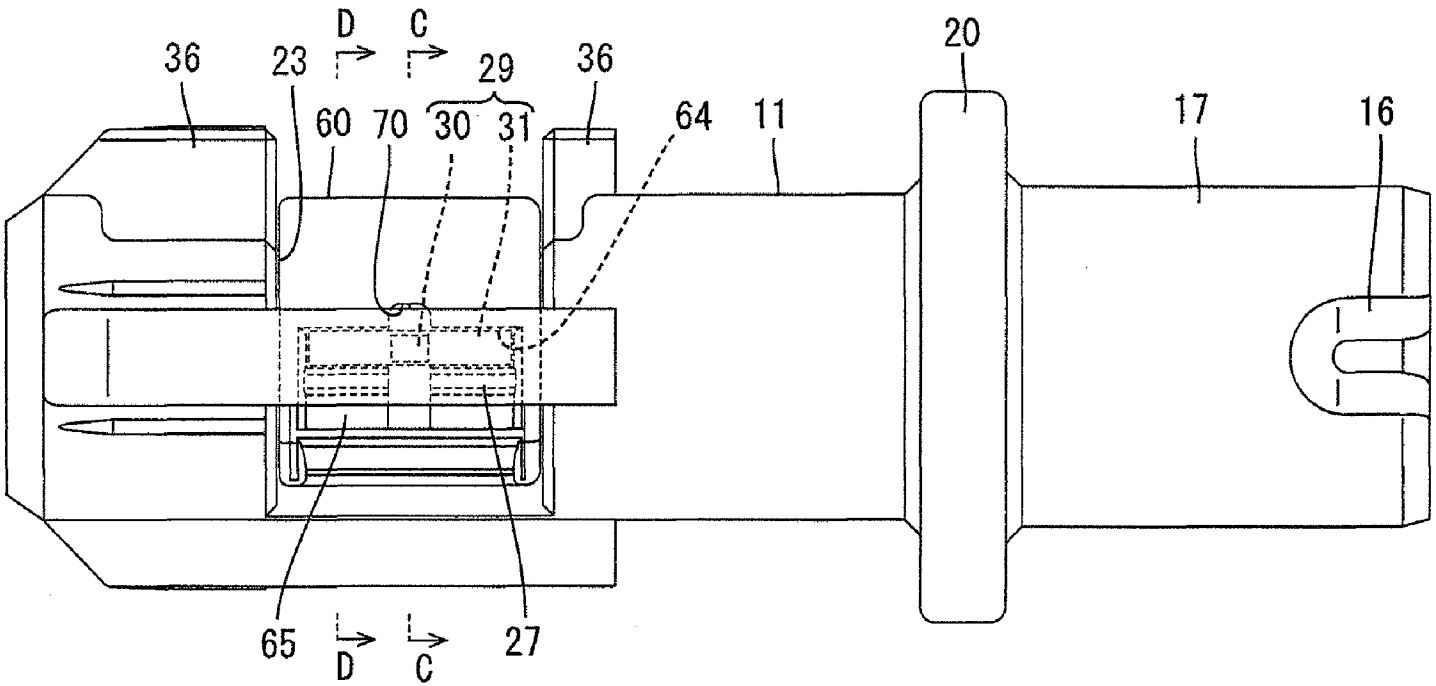
FIG. 22 is a side view of the inner housing when the retainer is disposed at a main locking position.

The terminal fittings 110 are inserted into the cavities 13 in this state. The body 61 of the retainer 60 is pressed from above after all terminal fittings 110 are inserted into the cavities 13 so that the retainer 60 is moved toward the main locking position. The fourth slope 34 of the locking projection 29 slides on the sixth slope 68 of the temporary locking concavity 65 during the movement of the retainer 60, and the elastic piece 62 is deformed flexibly in the flexible space. The elastic piece 62 restores elastically to its original state when the retainer 60 reaches the main locking position, and the second lock 31 of the locking projection 29 fits into the main locking concavity 64 (see FIG. 22). At this time, as shown in FIG. 24, the second slope 35 of the locking projection 29 is disposed substantially along the surface direction of the first slope 67 of the main locking concavity 64, and the fourth slope 34 of the locking projection 29 is disposed along the surface direction of the fifth slope 66 of the main locking concavity 64. Thus, the retainer 60 is held at the main locking position in a movement prevention state.

The first lock 30 of the locking projection 29 penetrates into the escape hole 70 and does not interfere with the retainer 60 while the retainer 60 is moving toward the main locking position and after the retainer 60 reaches the main locking position, as shown in FIGS. 20 and 23. The outer surface of the body 61 of the retainer 60 is lower than the outer surface of the inner housing 11 when the retainer 60 reaches the main locking position, as shown in FIG. 2, and the removal prevention part 63 of the retainer 60 is at the rear end of the body 111 of the terminal fitting 110 so that the terminal fitting 110 cannot be removed from the cavity 13.

The retainer 60 may be returned to the temporary locking position for maintenance or the like by pulling the body 61 of the retainer 60 up toward the temporary locking position. The second slope 35 of the locking projection 29 slides on the first slope 67 of the main locking concavity 64 while the retainer 60 is being moved to the temporary locking position, and the elastic piece 62 of the retainer 60 is deformed in the flexing space. The elastic piece 62 restores elastically to its original state when the retainer 60 reaches the temporary locking position. As a result, as shown in FIG. 20, the second locking surface 33 of the locking projection 29 contacts the first locking surface 69 of the temporary locking concavity 65 along a direction orthogonal to the direction in which the retainer 60 withdrawn. Thus, the retainer 60 cannot accidentally pass the temporary locking position and slip out of the inner housing 11.

The terminal fitting 110 can be inserted into the cavity 13 after the inner housing 11 is mounted in the outer housing 12. To mount the inner housing 11 in the outer housing 12, the convex portion 43 of the outer housing 12 is fit into the concave portion 19 of the inner housing 11. The front end of the convex portion 43 advances deep into the inner side of the concave portion 19 as the mounting operation proceeds. The inner lock 16 elastically locks to the inner locking receiving portion 47 when the convex portion 43 is fit into the concave portion 19 in a normal depth (see FIG. 16). Thus the inner housing 11 is held in the outer housing 12 in a fit-in state.

Figure 17:
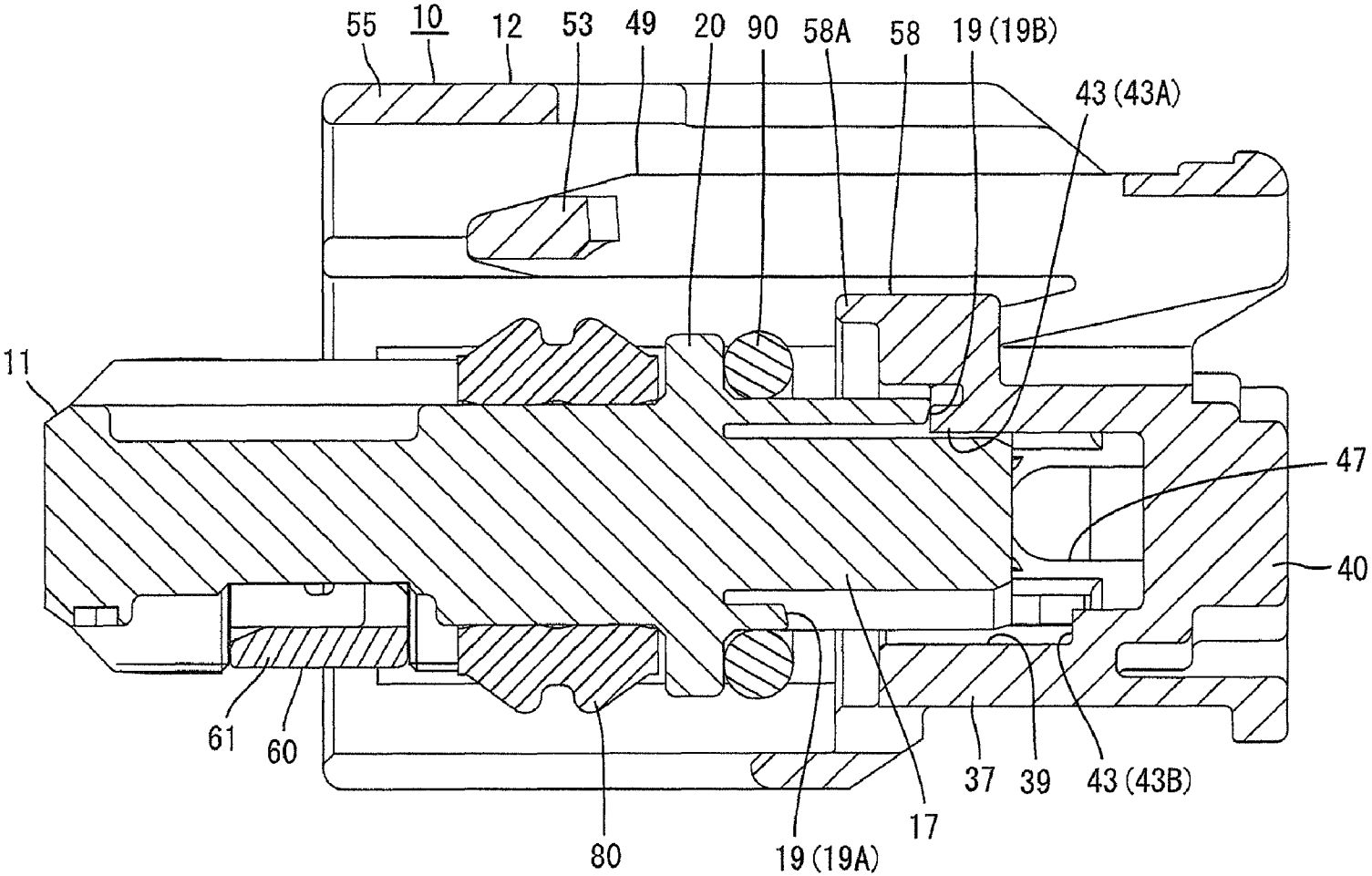
FIG. 17 is a sectional view showing a state in which an erroneous mounting of the outer housing on the inner housing is prevented.

The inner housing 11 could be in an inverted posture during an attempt to mount the inner housing 11 in the outer housing 12, as shown in FIG. 17. However, the front end of the long convexity 43A (disposed at upper side in normal posture) interferes with the inner end of the short concavity 19B (disposed at lower side in normal posture) before the long convexity 43A is fit in the shallow concavity 19B, thereby preventing further fitting of the inner housing 11 in the outer housing 12. Hence, the inner housing 11 cannot be fit in the outer housing 12 in an erroneous posture. Additionally, the long convexity 43A is sectionally triangular and hardly undergoes plastic deformation, upon contact with the inner end of the concavity 19B.

The elastic member 90 is compressed slightly between the first contact surface 21 of the flange 20 and the second contact surface 57 of the body 37 of the outer housing 12 before the housing 10 is fit on the mating housing 120 in a state in which the inner housing 11 is fit normally in the outer housing 12. However, the elastic member 90 is spaced at a certain gap from the hold-down part 58.

The mating housing 120 then is fit on the fit-on tubular part 38 of the outer housing 12 from the front of the housing 10, as shown in FIG. 1, and the inner housing 11 is inserted into the hood 121. When the housings 10 and 120 are fit together, the front end of the hood 121 is disposed radially outward from the flange 20, and the locking arm 49 elastically locks the lock of the mating housing 120 to hold the housings 10 and 120 together. At this time, the sealing member 80 is compressed between the inner surface of the hood 121 and the outer surface of the inner housing 11 to seal the gap between the housings 10 and 120.

The elastic member 90 is compressed between the first contact surface 21 of the flange 20 and the second contact surface 57 of the body 37 of the outer housing 12 when the housings 10 and 120 are fit normally together. At this time, the elastic member 90 elongates radially outward. However, the protrusion 58A of the hold-down part 58 contacts the outer end of the elastic member 90 to limit outward elongation. The limiting of the outward elongation of the elastic member 90 suppresses a decrease in the elastic restoring force of the elastic member 90. As a result, a proper separation force acts between the housings 10 and 120. Thus the reliability of the shake prevention performance of the elastic member 90 is ensured. The hold-down part 58 contacts the central portion of the elastic member 90 in its width direction. Thus, the elastic member 90 will not deform elastically at one side in its width direction.

The connector disclosed in Japanese Patent Application Laid-Open No. 2009-4111 has an elastic member that elongates outward in a direction orthogonal to the fit-on direction when the elastic member is compressed. Thus, there is a fear that the elastic restoring force of the elastic member decreases. The connector is provided with an escape prevention construction to suppress outward elongation of the elastic member. However, the connector is large due to the addition of the escape prevention construction and cannot comply with a demand for miniaturization.

On the other hand, the compressed elastic member 90 of the subject invention contacts the hold-down part 58 to restrain outward elongation of the elastic member 90. Thus, the elastic restoring force of the elastic member 90 does not decrease and the reliability of shake prevention performance is enhanced. Further, the hold-down part 58 radially overlaps the locking arm 49 and hence does not enlarge the connector.

Further the locking arm 49 has two legs 50 at the central portion of the housing 10 in its width direction, and the hold-down part 58 is disposed between the legs 50 arranged in the width direction of the housing 10 in a front view. Thus the elongation of the elastic member 90 is suppressed in a favorable balance at the central portion of the housing 10 in its width direction. Therefore, the reliability of the shake prevention performance of the elastic member 90 is enhanced.

Furthermore the hold-down part 58 is formed on the outer housing 12 which is a part of the housing 10. Hence, construction of a molding die is simpler than if the hold-down part 58 is formed inside the entire housing 10.

If the inner housing 11 had concavities of different sectional configurations and the outer housing 12 had convexities of different sectional configurations corresponding to the sectional configurations of the concavities, the concavities discriminate the configurations of the convexities, and the convexities discriminate those of the convexities. Thus, it is possible to detect the fit-on between the inner and outer housings 11 and 12 (referred to hereinafter as configuration detection). In addition by locating the convexities and the concavities at positions where the convexities and the concavities do not correspond to each other when the inner and outer housings 11 and 12 are erroneously fit together, it is possible to detect the fit-on between the inner and outer housings 11 and 12 (referred to hereinafter as position detection).

But in the case of the configuration detection, when the differences in shapes of the convexities and the concavities are very small, there is a fear that the convexity is inserted into the concavity with the convexity plastically deforming and fit-in may proceed even though the convexity cannot fit in the concavity. In the case of the position detection, when there is a restriction in the configuration of the inner and outer housings 11 and 12, it is difficult to determine the forming position of each convexity and concavity. Thus this case has a problem that the degree of freedom in design is low. In the field of the connector, the above-described situation also applies to fit-on of members other than that of the inner and outer housings 11 and 12.

On the other hand, in the subject invention, the outer housing 12 has convexities 43 of different extended lengths in the fit-on direction, and the inner housing 11 has concavities 19 with depths corresponding to the extended lengths of the convexities 43. Thus when the convexities 43 are inserted into the concavities 19 to a normal depth, a normal fit-on state between the inner and outer housings 11 and 12 is detected. When the convexities 43 are not inserted into the concavities 19 to a normal depth, an abnormal fit-on state between the inner and outer housings 11 and 12 is detected. Therefore, detection means other than the prior art configuration detection means and the position detection means are provided to prevent the inner and outer housings 11 and 12 from being fit together erroneously.

The inner housing 11 has the two side by side tubular towers 17 and the concavity 19 is formed between the towers 17. Thus, the dead space between the adjacent towers 17 is utilized and the connector has excellent space efficiency.

The upper convexity 43A is sectionally triangular with straight opposite sides 45 each having an open angle corresponding to the upper concavity 19A. Thus, it is possible to avoid the upper convexity 43A from being scraped off by interference of the upper convexity 43A with the lower concavity 19B during an erroneous fit-on.

According to the invention, the forward surface of the main locking concavity 64 in the direction in which the retainer 60 is drawn out has the first slope 67 formed on the forward surface thereof and the first slope 67 is inclined along the direction in which the retainer 60 is drawn out. The forward surface of the locking projection 29 in the direction in which retainer 60 is drawn out has the second slope 35 that extends substantially along the direction of the first slope 67 at the main locking position. Therefore, the first slope 67 and the second slope 35 slide on each other when returning the retainer 60 from the main locking position to the temporary locking position and the retainer 60 can be returned smoothly to the temporary locking position.

The first locking surface 69 is formed on the forward surface temporary locking concavity 65 in the direction in which the retainer 60 is drawn out and is substantially orthogonal to the direction in which retainer 60 is drawn out. The locking projection 29 has the second locking surface 33 disposed substantially along the direction of the first locking surface 69 at the temporary locking position. Therefore, the first and second locking surfaces 69 and 33 are locked tightly together against the removal direction of the retainer 60 as the retainer 60 advances to the temporary locking position. Thus, the retainer 60 will not separate from the housing 10. In this case, the second slope 35 and the second locking surface 33 are formed together on the locking projection 29. Thus, the housing has a simple construction as compared with a construction in which the second slope 35 and the second locking surface 33 are formed at different portions.

The second slope 35 on the locking projection 29 is disposed at both sides of the second locking surface 33. Thus, the retainer 60 has a favorable balance in its movement posture when the first slope 67 and the second slope 35 slide on each other.

The escape 70 is formed on the retainer 60 and extends in the movement direction of the retainer 60 between the main locking concavity 64 and the temporary locking concavity 65. The first lock 30 of the locking projection 29 penetrates the escape hole 70 during movement of the retainer 60. Therefore the first lock 30 does not interfere with the first slope 67 of the main locking concavity 64 and thus the retainer 60 moves smoothly. In addition, because this construction is capable of securing a large locking area of the second locking surface of the first lock 30, the construction reliably prevents the removal of the retainer 60 from the housing.

The invention is not limited to the embodiment described above with reference to the drawings. For example, the following embodiments are also included in the technical scope of the present invention.

In addition to the upper convexity, the lower convexity may be triangular in section.

The temporary locking concavity and the main locking concavity may be formed on the housing, and the locking projection may be formed on the retainer.

The escape hole may be bottomed.

The first through sixth slopes may be curved.

The hold-down part may be formed on the inner housing.

Plurality hold-down parts may be formed in the circumferential direction.

The hold-down part may be formed over the entire circumference.

It is possible to form not less than three hold-down parts and opposed tubular portions by arranging them side by side and a plurality of concavities and convexities.

In mounting the cover on the housing, it is possible to form a concavity on one of the housing and the cover and the convexity on the other of the housing and the cover.

What is claimed is:

1. A connector comprising:

a housing which can be fitted on a mating housing and into which terminal fittings are inserted;

a retainer mounted on the housing movably between a temporary locking position and a main locking position, the retainer allowing the terminal fittings to be inserted into the housing at the temporary locking position, and preventing the terminal fittings from being drawn out of the housing at the main locking position;

a main locking concavity formed on one of said housing and said retainer and having a first slope formed on a forward surface thereof in a direction in which said retainer is drawn out, the first slope being inclined along the direction in which the retainer is drawn out;

a temporary locking concavity formed on one of said housing and said retainer and having a first locking surface formed on a forward surface thereof in the direction in which said retainer is drawn out, the first locking surface being substantially orthogonal to the direction in which the retainer is drawn out;

a locking projection (29) formed on the other of said housing and said retainer, the locking projection being fit elastically in the temporary locking concavity at the temporary locking position for holding the retainer at the temporary locking position, and elastically fit in the main locking concavity at the main locking position for holding the retainer at the main locking position;

a second slope formed on a forward surface of the locking projection in the direction in which the retainer is drawn out, the second slope being disposed on the first slope substantially along a surface direction of said first slope at the main locking position; and a second locking surface formed on the forward surface of said locking projection in said direction in which said retainer is drawn out, the second locking surface being disposed substantially along a surface direction of said first locking surface at said temporary locking position.

2. The connector of claim 1, wherein said second slope of said locking projection is disposed at both sides of said second locking surface.

3. The connector of claim 2, wherein an escape hole is formed on one of the housing and the retainer at a position between the main locking concavity and the temporary locking concavity, the escape hole extending in a direction in which the retainer moves, the second locking surface of the locking projection advancing in the escape hole during movement of the retainer.

4. The connector of claim 1, wherein the housing has a first and second members fit together; concavities formed on said first member and extending in a fit-on direction, and convexities formed on said second member and extending in said fit-on direction, the convexities being inserted respectively into the concavities when the first and second members are fit together, the convexities having different extended lengths in the fit-on direction, and said concavities having different extended lengths corresponding to the lengths of the respective convexities.

5. The connector of claim 4, wherein said first member has two tubular towers disposed side by side, said concavities being formed between said towers.

6. The connector of claim 5, wherein said concavities are partitioned by circular arc surfaces of the towers and have sharp apices in correspondence to a position where the circular arc surfaces join each other; said convexities including a forward convexity that interferes with said concavity in an erroneous fit-on operation is sectionally triangular with straight opposite sides each having an open angle corresponding to said concavity.

7. The connector of claim 4, wherein the first and second members of the housing are defined by a block-shaped inner housing into which terminal fittings are inserted and a tubular outer housing surrounding a periphery of the inner housing.

8. The connector of claim 1, wherein the housing has a locking arm holding a mating housing in a separation prevention state when said housing and said mating housing are fit together;

an annular elastic member mounted on the housing is compressed in a fit-on direction when the housings are fit together to prevent the housings from shaking;

the housing having a hold-down part contacts the elastic member placed in a compressed state thereof substantially orthogonal to the fit-on direction to suppress elongation of the elastic member in the radial direction; and the hold-down part overlaps the locking arm in the radial direction.

9. The connector of claim 8, wherein the locking arm has two legs at a central portion of said housing in a width direction thereof; and said hold-down part being between the legs in a front view.

10. The connector of claim 8, wherein the housing has a tubular outer housing and a block-shaped inner housing inserted into said outer housing and held thereby; and said hold-down part being formed on said outer housing or said inner housing.

* * * * *